US010464313B2

(12) United States Patent
Shinbara et al.

(10) Patent No.: US 10,464,313 B2
(45) Date of Patent: Nov. 5, 2019

(54) LIQUID DROPLET EJECTING APPARATUS AND METHOD FOR MAINTENANCE OF LIQUID DROPLET EJECTING APPARATUS

(71) Applicant: SEIKO EPSON CORPORATION, Tokyo (JP)

(72) Inventors: Toshihiro Shinbara, Matsumoto (JP); Toshio Nakata, Matsumoto (JP); Toshiyuki Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/027,464

(22) Filed: Jul. 5, 2018

(65) Prior Publication Data

US 2019/0016122 A1 Jan. 17, 2019

(30) Foreign Application Priority Data

Jul. 7, 2017 (JP) ..... 2017-133750

(51) Int. Cl.

| | |
|---|---|
| ***B41J 2/045*** | (2006.01) |
| ***B41J 2/165*** | (2006.01) |
| ***B41J 29/38*** | (2006.01) |
| ***B41J 2/14*** | (2006.01) |

(Continued)

(52) U.S. Cl.

CPC ..... *B41J 2/04508* (2013.01); *B41J 2/04586* (2013.01); *B41J 2/14233* (2013.01); *B41J 2/165* (2013.01); *B41J 2/16505* (2013.01); *B41J 2/16508* (2013.01); *B41J 2/16526* (2013.01); *B41J 2/175* (2013.01); *B41J 2/17566* (2013.01); *B41J 2/17596* (2013.01); *B41J 2/195* (2013.01); *B41J 29/38* (2013.01); *B41J 2002/14241* (2013.01); *B41J 2002/14362* (2013.01); *B41J 2002/14419* (2013.01); *B41J 2002/17576* (2013.01)

(58) Field of Classification Search

CPC ..... B41J 2/04508; B41J 2/04586; B41J 2/16505; B41J 2/16579

USPC ..... 347/23, 29

See application file for complete search history.

(56) References Cited

U.S. PATENT DOCUMENTS

| | | | |
|---|---|---|---|
| 2005/0122360 | A1 | 6/2005 | Sakagami et al. |
| 2009/0109257 | A1 | 4/2009 | Shimazaki |
| 2011/0285775 | A1 | 11/2011 | Shinkawa |

(Continued)

FOREIGN PATENT DOCUMENTS

| | | | |
|---|---|---|---|
| JP | 2000-117993 | A | 4/2000 |
| JP | 2003-039701 | A | 2/2003 |

(Continued)

*Primary Examiner* — An H Do

(74) *Attorney, Agent, or Firm* — Workman Nydegger

(57) ABSTRACT

A liquid droplet ejecting apparatus includes a liquid droplet ejecting head that includes a pressure chamber to which a liquid is supplied from a liquid supply source, a nozzle that communicates with the pressure chamber, and an actuator that vibrates the pressure chamber, and discharges a liquid droplet from the nozzle by driving of the actuator, a cap designed to make a capping state where the cap is in contact with the liquid droplet ejecting head to form a space where the nozzle opens and a non-capping state where the cap is separated from the liquid droplet ejecting head, and a detection unit designed to detect a state in the pressure chamber, in which in the capping state, the detection unit detects the state in the pressure chamber.

9 Claims, 23 Drawing Sheets

(51) Int. Cl.
*B41J 2/175* (2006.01)
*B41J 2/195* (2006.01)

(56) References Cited

U.S. PATENT DOCUMENTS

| | | | |
|---|---|---|---|
| 2014/0168299 | A1 | 6/2014 | Kamibayashi et al. |
| 2016/0167364 | A1 | 6/2016 | Matsumoto et al. |
| 2018/0250938 | A1* | 9/2018 | Kawakami ..... B41J 2/1433 |

FOREIGN PATENT DOCUMENTS

| | | | |
|---|---|---|---|
| JP | 2004-276273 | A | 10/2004 |
| JP | 2007-136772 | A | 6/2007 |
| JP | 2011-240564 | A | 12/2011 |
| JP | 2012-121334 | A | 6/2012 |
| JP | 2014-094449 | A | 5/2014 |
| JP | 2014-138996 | A | 7/2014 |
| JP | 2016-112713 | A | 6/2016 |

* cited by examiner

LIQUID DROPLET EJECTING APPARATUS AND METHOD FOR MAINTENANCE OF LIQUID DROPLET EJECTING APPARATUS

BACKGROUND

1. Technical Field

The present invention relates to a liquid droplet ejecting apparatus such as a printer and a method for maintenance of the liquid droplet ejecting apparatus.

2. Related Art

An example of a liquid droplet ejecting apparatus includes an ink jet printer that performs capping for covering a nozzle of a recording head with a cap when printing is not performed and suppresses drying of the nozzle (for example, JP-A-2003-39701).

Even when performing the capping, drying of the nozzle cannot be completely prevented. Therefore, when printing is started with separating the cap from a recording head, ejecting failure of liquid droplets occurs in some cases.

SUMMARY

An advantage of some aspects of the invention is that provide a liquid droplet ejecting apparatus capable of maintaining a state where the liquid droplets can be efficiently ejected by suppressing the ejecting failure after capping and a method for maintenance of the liquid droplet ejecting apparatus.

According to an aspect of the invention, there is provided an liquid droplet ejecting apparatus including a liquid droplet ejecting head that includes a pressure chamber to which a liquid is supplied from a liquid supply source, a nozzle that communicates with the pressure chamber, and an actuator that vibrates the pressure chamber, and discharges a liquid droplet from the nozzle by driving of the actuator, a cap designed to make a capping state where the cap is in contact with the droplet ejecting head to form a space where the nozzle opens and a non-capping state where the cap is separated from the liquid droplet ejecting head, and a detection unit capable of detecting a state in the pressure chamber, in which in the capping state, the detection unit detects the state in the pressure chamber.

According to another aspect of the invention, there is provided a method for maintenance of a liquid droplet ejecting apparatus including a liquid droplet ejecting head that includes a pressure chamber to which a liquid is supplied from a liquid supply source, a nozzle that communicates with the pressure chamber, and an actuator that vibrates the pressure chamber, and discharges a liquid droplet from the nozzle by driving of the actuator, a cap designed to make a capping state where the cap is in contact with the droplet ejecting head to form a space where the nozzle opens and a non-capping state where the cap is separated from the liquid droplet ejecting head, and a detection unit designed to detect a state in the pressure chamber, the method including in the capping state, detecting a state in the pressure chamber, and in a case where the detection unit detects that the state in the pressure chamber is not normal, performing a maintenance of the liquid droplet ejecting head is performed by discharging liquid the liquid from the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid droplet ejecting apparatus will be described with reference to drawings. The liquid droplet ejecting apparatus of the present embodiments is an ink jet printer that performs printing on a medium such as recording paper by ejecting an ink that is an example of a liquid.

First Embodiment

Figure 1:
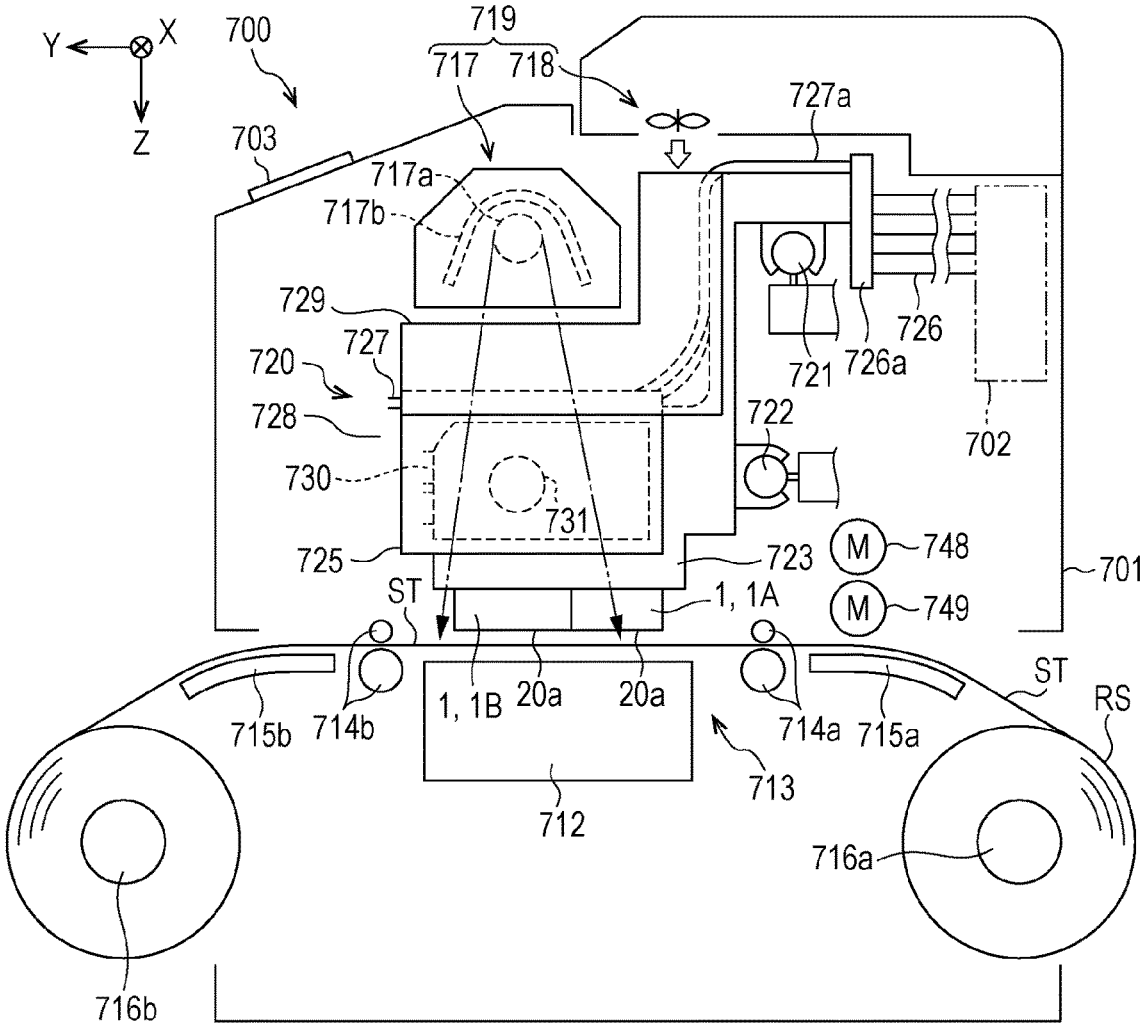
FIG. 1 is a schematic diagram illustrating one embodiment of a liquid droplet ejecting apparatus.

As illustrated in FIG. 1, a liquid droplet ejecting apparatus 700 includes a support table 712, a transporting unit 713, a printing unit 720, a drying unit 719, guide shafts 721 and 722, a housing 701 accommodating these components. The support table 712 and the guide shafts 721, 722 extend in an X axis direction which is a width direction of a medium ST. The housing 701 includes an operation panel 703 for performing an operation and displaying an operation state.

The transporting unit 713 transports the sheet-like medium ST. The printing unit 720 discharges liquid droplets toward the medium ST to be transported at a printing position set on the support table 712. A Y axis direction is the transport direction of the medium ST at the printing position. The drying unit 719 promotes the drying of the liquid attached onto medium ST. The X axis and the Y axis intersect with a Z axis. The Z axis direction of the present embodiment is the direction of gravity and is the direction of ejecting of liquid.

The transporting unit 713 includes a pair of transporting rollers 714*a*, a guide plate 715*a*, and a supply reel 716*a* that are disposed at the downstream side of the support table 712 in the transporting direction, a pair of transporting rollers 714*b*, a guide plate 715*b*, and a winding reel 716*b* that are disposed at the upstream side of the support table 712 in the transporting direction. The transporting unit 713 includes a transporting motor 749 that rotates the pairs of the transporting rollers 714*a* and 714*b*.

The medium ST is drawn out from a roll sheet RS wound in a roll on the supply reel 716*a*. When the pair of transporting rollers 714*a* and 714*b* rotate while sandwiching the medium ST, the medium ST is transported along the surfaces of the guide plate 715*a*, the support table 712, and the guide plate 715*b*. The printed medium ST is wound on the winding reel 716*b*.

The printing unit 720 includes a carriage 723 supported by the guide shafts 721 and 722, and a carriage motor 748. By driving the carriage motor 748, the carriage 723 reciprocates above the support table 712 along the guide shafts 721 and 722.

The liquid droplet ejecting apparatus 700 includes a plurality of supply tubes 726 deformable following the reciprocating carriage 723 and a connection portion 726*a* attached to the carriage 723. The upstream end of supply tube 726 is connected to a liquid supply source 702 and the downstream end of supply tube 726 is connected to connection 726*a*. The liquid supply source 702 may be, for example, a tank that stores the liquid, or a cartridge detachable from the housing 701.

The printing unit 720 includes two liquid droplet ejecting heads 1 (1A and 1B), a liquid supply path 727, a storage unit 730, and a storage unit holder 725 that holds the storage unit 730 as constituent elements held by the carriage 723, and a flow path adapter 728 connected to the storage unit 730. Liquid droplet ejecting heads 1A and 1B are held at the lower portion of the carriage 723, and the storage unit 730 is held at the upper portion of the carriage 723. The liquid supply path 727 supplies the liquid supplied from the liquid supply source 702 to the liquid droplet ejecting heads 1A and 1B.

The storage unit 730 temporarily stores the liquid between the liquid supply path 727 and the liquid droplet ejecting head 1. The storage unit 730 is provided for each kind of liquid at least. When the liquid droplet ejecting apparatus 700 includes a plurality of storage units 730 and stores different color inks in the storage unit 730, it is possible to perform color printing.

Examples of ink colors include cyan, magenta, yellow, black, white, and the like. Color printing may be performed in four colors of cyan, magenta, yellow, and black, or may be performed in three colors of cyan, magenta, and yellow. Furthermore, at least one of light cyan, light magenta, light yellow, orange, green, gray and the like may be added to three colors of cyan, magenta and yellow. Each ink may contain a preservative.

The white ink may be used for background printing (also referred to as solid printing) before performing color printing when printing on the medium ST which is a transparent or translucent film or the dark color medium ST.

The storage unit 730 includes a differential pressure valve 731 provided in the liquid supply path 727. The differential pressure valve 731 is a so-called pressure reducing valve. That is, when the liquid is consumed by the liquid droplet ejecting head 1 and the liquid pressure of the liquid supply path 727 between the differential pressure valve 731 and the liquid droplet ejecting head 1 is lower than a predetermined negative pressure lower than an atmospheric pressure, the differential pressure valve 731 is opened and allows the liquid to flow from the storage unit 730 to the liquid droplet ejecting head 1. When the liquid pressure of the liquid supply path 727 between the differential pressure valve 731 and the liquid droplet ejecting head 1 returns to the predetermined negative pressure due to the flow of the liquid, the differential pressure valve 731 closes to stop the flow of the liquid. The differential pressure valve 731 does not open even when the liquid pressure in the liquid supply path 727 between the differential pressure valve 731 and the liquid droplet ejecting head 1 becomes high. Therefore, the differential pressure valve 731 functions as a one-way valve (a check valve) that allows the liquid to flow from the storage unit 730 to the liquid droplet ejecting head 1 and suppresses the flow of the liquid in the opposite direction.

The liquid supply path 727 includes a supply tube 727*a* to which the upstream end is connected to the connection portion 726*a*. The downstream end of the supply tube 727*a* is connected to the flow path adapter 728 at a position higher than the storage unit 730. The liquid sequentially passes through the supply tube 726, the supply tube 727*a* and the flow path adapter 728 and is supplied to the storage unit 730.

The drying unit 719 includes a heat generating mechanism 717 and a blower mechanism 718. The heat generating mechanism 717 is disposed above the carriage 723. When the carriage 723 reciprocates between the heat generating mechanism 717 and the support table 712, the liquid droplet ejecting head 1 discharges the liquid droplets onto the medium ST stopped on the support table 712.

The heat generating mechanism 717 includes a heat generating member 717*a* extending in the X axis direction and a reflecting plate 717*b*. The heat generating member 717*a* is, for example, an infrared heater. The heat generating mechanism 717 emits heat (for example, radiant heat) such as an infrared ray or the like from the heat generating member 717*a*, and heats the medium ST in the area indicated by the one-dot chain line arrow in FIG. 1. The blower mechanism 718 blows air to the area heated by the heat generating mechanism 717 to promote drying of the medium ST.

The carriage 723 includes a heat shield member 729 for shielding heat transfer from the heat generating mechanism 717 between the storage unit 730 and the heat generating mechanism 717. The heat shield member 729 is formed of a metal material with a good thermal conductivity such as stainless steel or aluminum, for example. It is preferable that the heat shield member 729 covers at least the upper surface of the storage unit 730.

Figure 2:
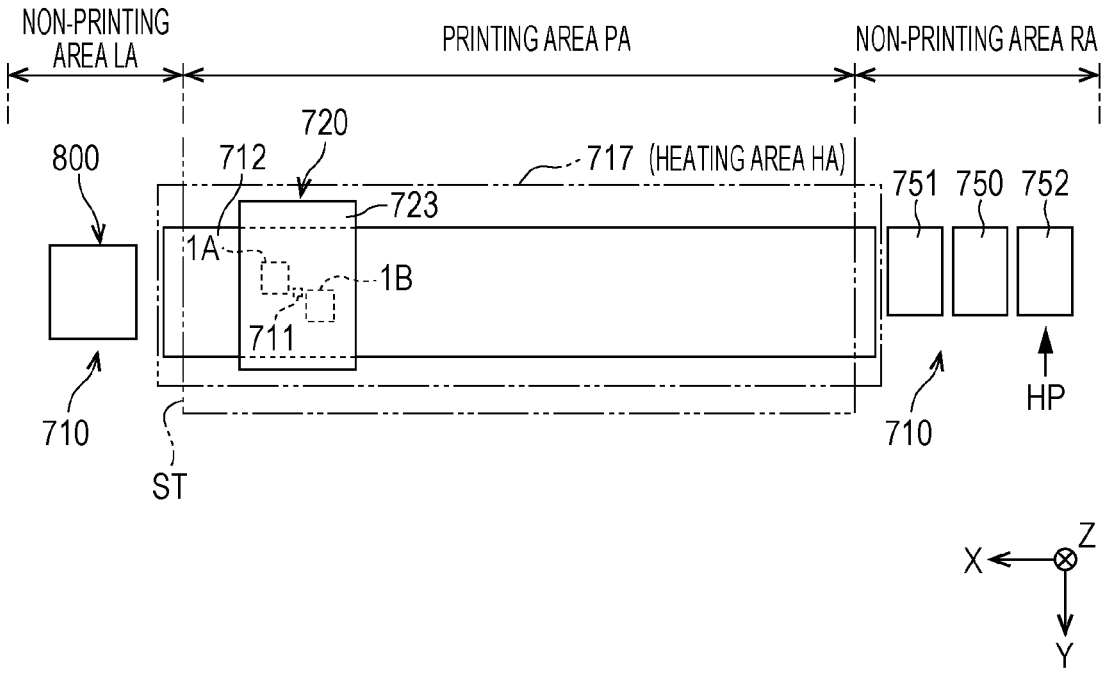
FIG. 2 is a plan view illustrating an arrangement of constituent elements of the liquid droplet ejecting apparatus in FIG. 1.

As illustrated in FIG. 2, the liquid droplet ejecting heads 1A and 1B are arranged under the carriage 723 so as to be separated from each other by a predetermined distance in the X axis direction and to be shifted by a predetermined distance in the Y axis direction. The carriage 723 holds a temperature sensor 711 at a position between the liquid droplet ejecting heads 1A and 1B in the X axis direction.

The movement area in which the liquid droplet ejecting heads 1A and 1B are movable in the X axis direction includes a print area PA in which printing is performed on the medium ST and non-printing areas RA and LA outside the printing area PA. The non-printing areas RA and LA are positioned on both outer sides in the X axis direction of the printing area PA. The printing area PA is an area where the liquid droplet ejecting heads 1A and 1B can ejecting liquid droplets with respect to the medium ST having the maximum width. In a case where the printing unit 720 includes borderless printing function, the printing area PA slightly expands in the X axis direction than the medium ST having the maximum width. The heating area HA in which the heat generating mechanism 717 heats the medium ST overlaps the printing area PA.

The liquid droplet ejecting apparatus 700 includes a maintenance unit 710 for performing maintenance of the liquid droplet ejecting head 1. The maintenance unit 710 includes a cap device 800 disposed in the non-printing area LA, a wiping mechanism 750 disposed in the non-printing area RA, a liquid receiving mechanism 751, and a cap mechanism 752. The upper portion of the cap mechanism 752 becomes a home position HP of the liquid droplet ejecting heads 1A and 1B. The home position HP is a starting point of the forward movement of the liquid droplet ejecting heads 1A and 1B.

Regarding Configuration of the Head Unit

Next, the configuration of a head unit 2 will be described in detail.

Figure 6:
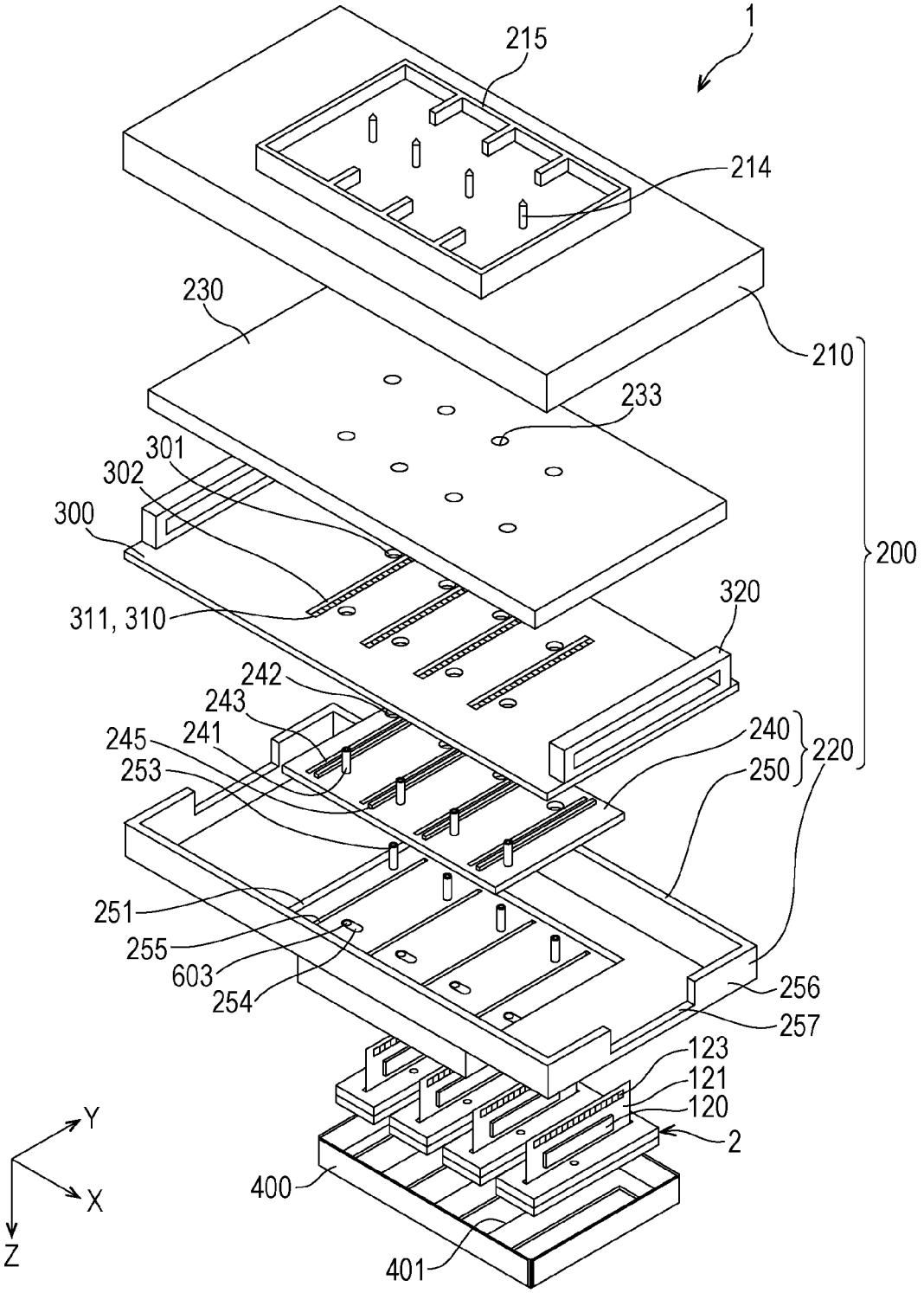
FIG. 6 is an exploded perspective view of a liquid droplet ejecting head of the liquid droplet ejecting apparatus of FIG. 1.

One liquid droplet ejecting head 1 includes a plurality of (four in the present embodiment) head units 2 (see FIG. 6). The head unit 2 is provided for each type of liquid.

Figure 3:
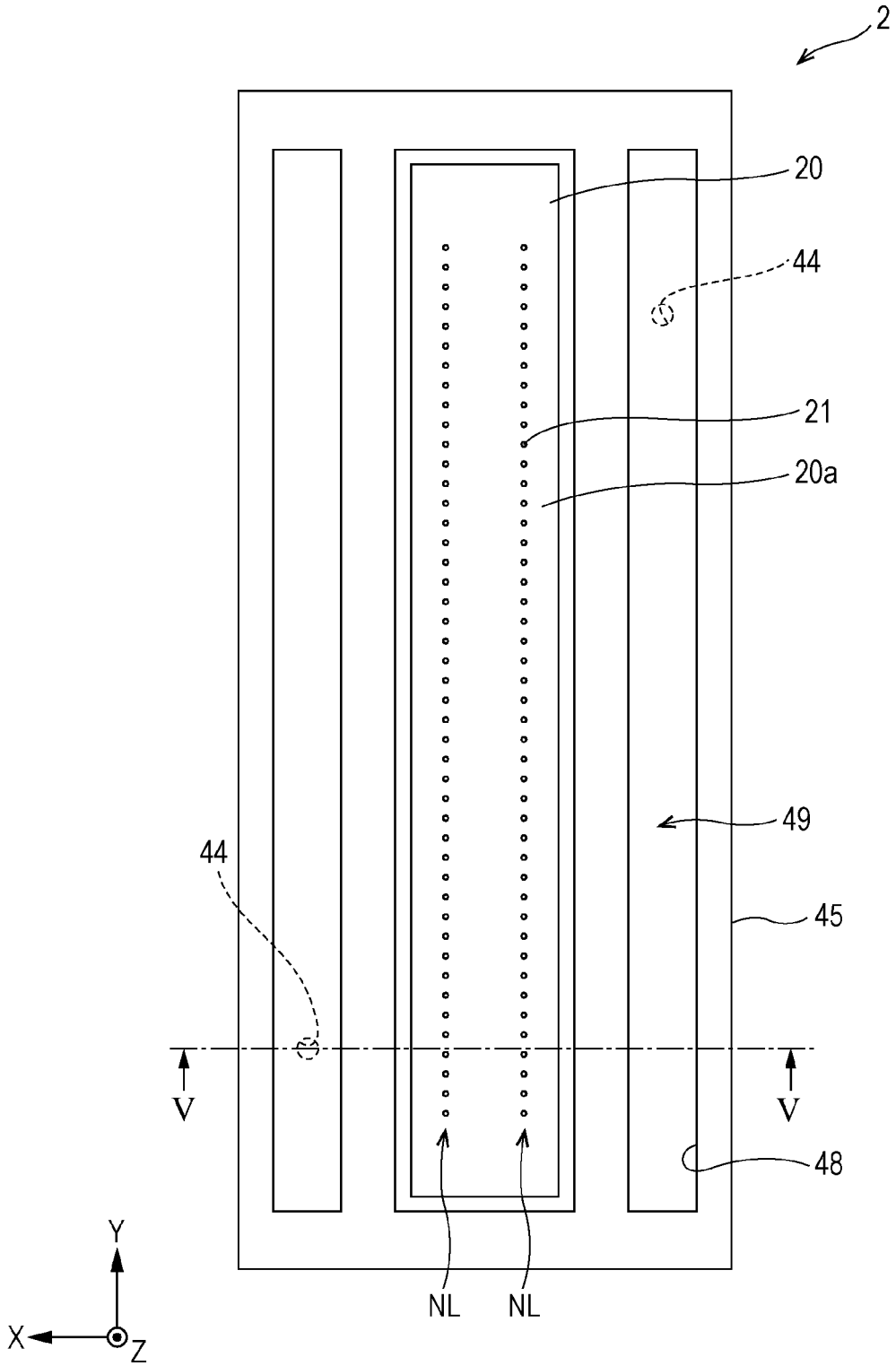
FIG. 3 is a bottom view of a head unit of the liquid droplet ejecting apparatus in FIG. 1.

As illustrated in FIG. 3, in one head unit 2, a large number (for example, 180) of openings of nozzles 21 for ejecting liquid droplets are arranged at regular intervals in one direction (Y axis direction in the present embodiment). The nozzles 21 arranged in one direction configures a nozzle row NL. In the present embodiment, two nozzle rows NL arranged in the X axis direction are provided in one liquid droplet ejecting head 1. Two nozzle rows NL arranged close to each other are called a nozzle group.

In one liquid droplet ejecting head 1, four nozzle groups (a total of eight rows of nozzle rows NL) are arranged at regular intervals in the X axis direction. When projecting the position of the nozzle 21 in the X axis direction, the two liquid droplet ejecting heads 1 are arranged such that the nozzles 21 at the extreme ends of the respective nozzle rows NL are the same as the nozzles 21 constituting one nozzle row NL The position in the Y axis direction is adjusted so as to be aligned at intervals.

Figure 4:
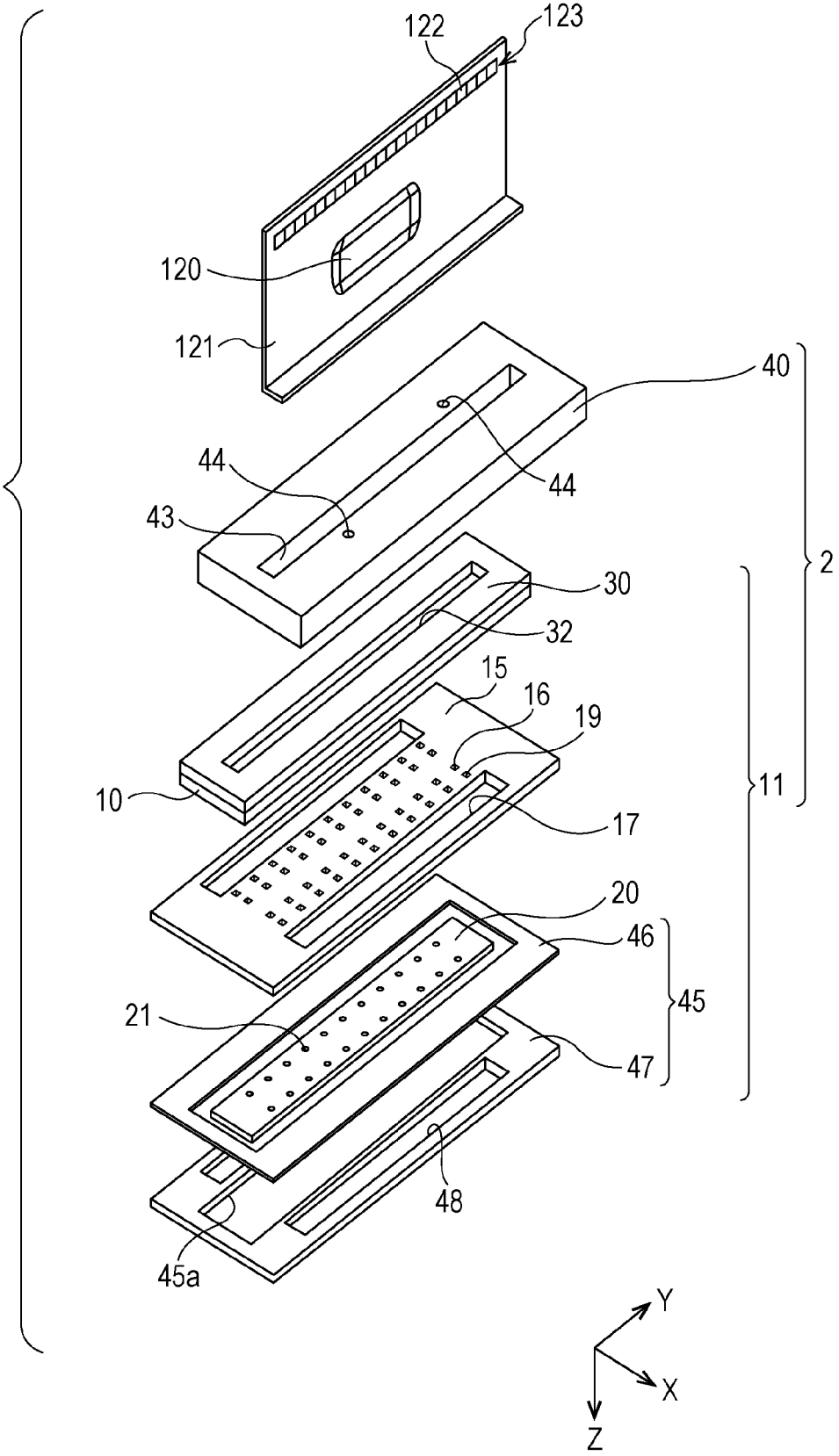
FIG. 4 is an exploded perspective view of the head unit in FIG. 3.

As illustrated in FIG. 4, the head unit 2 includes a head main body 11 and a flow path forming member 40 fixed to the upper surface side of a head main body 11. The head main body 11 includes a protective substrate 30, a flow path forming substrate 10, a communicating plate 15, a nozzle plate 20, and a compliance substrate 45 stacked in order from the flow path forming member 40. The communicating plate 15 is provided on the lower surface side of the flow path forming substrate 10. The protective substrate 30 is provided on the upper side of the flow path forming substrate 10. The nozzle plate 20 is provided on the lower surface side of the communicating plate 15. The compliance substrate 45 is provided on the surface side on which the nozzle plate 20 of the communicating plate 15 is provided.

As the flow path forming substrate 10, a metal such as stainless steel or Ni, a ceramic material typified by $ZrO_2$ or $Al_2O_3$, a glass ceramic material, an oxide such as MgO, $LaAlO_3$, or the like can be used. In the present embodiment, the flow path forming substrate 10 is formed of a silicon single crystal substrate.

Figure 5:
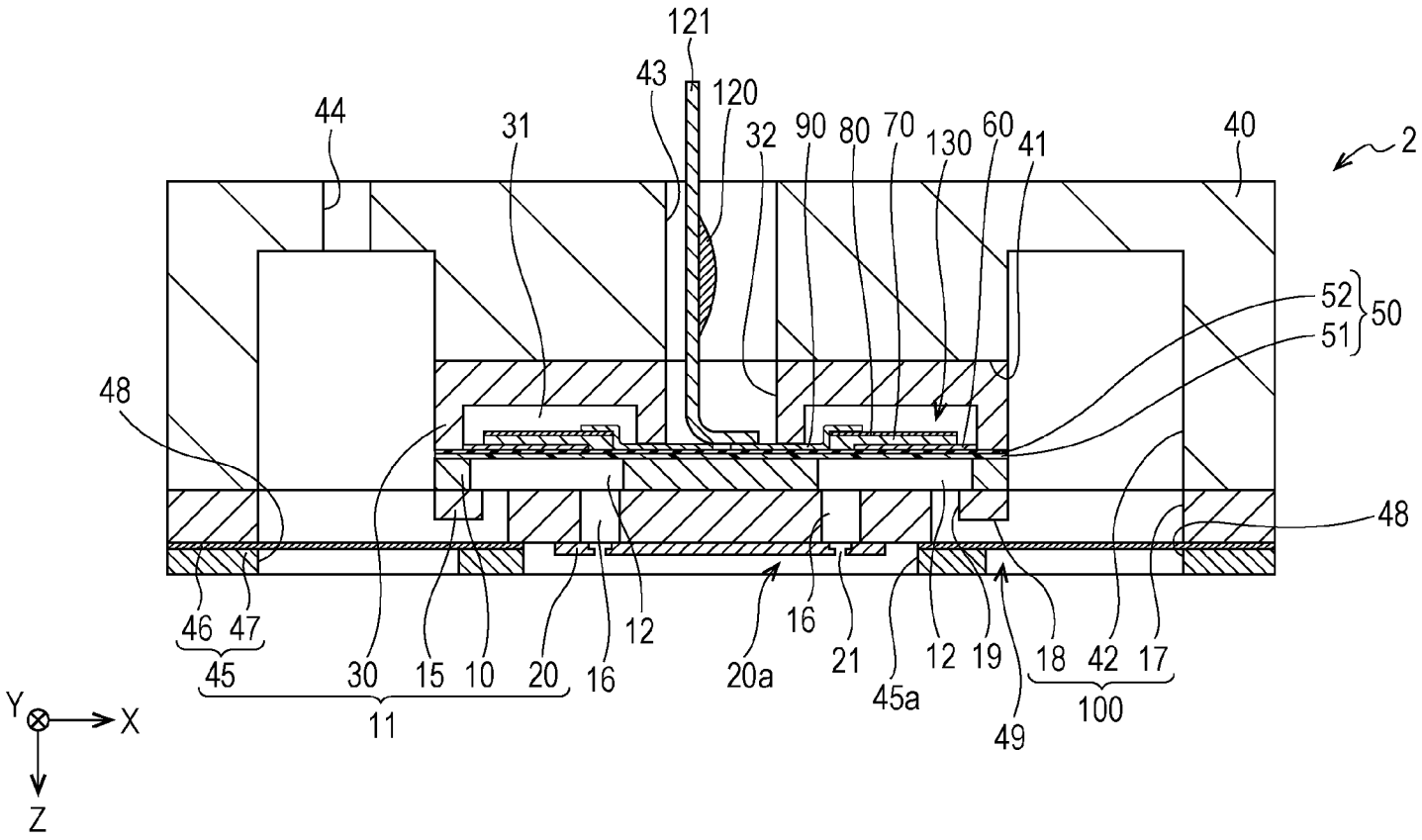
FIG. 5 is a sectional view taken along the line V-V in FIG. 3.

As illustrated in FIG. 5, in the flow path forming substrate 10, a plurality of pressure chambers 12 partitioned by partition walls are formed. The pressure chamber 12 is disposed above the nozzle 21. On the flow path forming substrate 10, a supply path and the like for providing a flow path resistance of the liquid flowing into the pressure chamber 12 having an opening area smaller than that of the pressure chamber 12 is provided at one end portion in the Y axis direction of the pressure chamber 12 may be used.

As illustrated in FIGS. 4 and 5, the nozzle plate 20 includes holes forming the nozzle 21. The downstream end of the nozzle 21 opens on a nozzle surface 20*a* which is the lower surface of the nozzle plate 20.

The communicating plate 15 is provided with a nozzle communicating path 16 that communicates the pressure chamber 12 and the nozzle 21. The communicating plate 15 has a larger plane area than the flow path forming substrate 10, and the nozzle plate 20 has a smaller planar area than the flow path forming substrate 10. By providing the communicating plate 15, since the nozzle 21 of the nozzle plate 20 and the pressure chamber 12 are separated from each other, the liquid in the pressure chamber 12 is hardly thickened due to evaporation of moisture in the liquid from the nozzle 21. In addition, since the nozzle plate 20 only has to cover the opening of the nozzle communicating path 16 that communicates the pressure chamber 12 and the nozzle 21, it is possible to make the area of the nozzle plate 20 relatively small and to reduce the cost.

As illustrated in FIG. 5, a first manifold portion 17 and a second manifold portion 18 (throttle flow path and orifice flow path) configuring a common liquid chamber 100 are provided in the communicating plate 15. The first manifold portion 17 penetrates the communicating plate 15 in the thickness direction (the Z axis direction which is the lamination direction of the communicating plate 15 and the flow path forming substrate 10). The second manifold portion 18 opens to the nozzle plate 20 side of the communicating plate 15 without penetrating the communicating plate 15 in the thickness direction.

A supply communicating path 19 communicating with one end portion of the pressure chamber 12 in the Y axis direction is independently provided for each pressure chamber 12 in the communicating plate 15. The supply communicating path 19 communicates the second manifold portion 18 and the pressure chamber 12.

A metal such as stainless steel or nickel (Ni), ceramics such as zirconium (Zr), or the like can be used to construct the communicating plate 15. The communicating plate 15 is preferably formed of a material having a coefficient of linear expansion equal to that of the flow path forming substrate 10. In a case where the communicating plate 15 is formed of a material having a greatly different linear expansion coefficient from the flow path forming substrate 10, warping may occur in the flow path forming substrate 10 and the communicating plate 15 by being heated or cooled. In the present embodiment, the same material as the flow path forming substrate 10, that is, a silicon single crystal substrate is used as the communicating plate 15 to suppress warping due to heat, cracking or peeling due to heat, or the like.

In order to form the nozzle plate 20, for example, a metal such as stainless steel (SUS), an organic material such as a polyimide resin, a silicon single crystal substrate, or the like can be used. When the silicon single crystal substrate is used as the nozzle plate 20, the linear expansion coefficients of the nozzle plate 20 and the communicating plate 15 become equal. As a result, warping due to heat, cracking or peeling due to heat, or the like can be suppressed.

A vibrating plate 50 is disposed on the side of the flow path forming substrate 10 opposite to the communicating plate 15. In the present embodiment, as the vibrating plate 50, an elastic film 51 formed of silicon oxide provided on the flow path forming substrate 10 side and an insulating film 52 formed of zirconium oxide provided on the elastic film 51 are provided. The liquid flow path such as the pressure chamber 12 is formed by anisotropically etching the flow path forming substrate 10 from one surface side (the surface side to which the nozzle plate 20 is bonded), and a liquid flow such as the pressure chamber 12 The other side of the road is defined by an elastic film 51.

An actuator 130 which is pressure generating means of the present embodiment is provided on the vibrating plate 50 of the flow path forming substrate 10. The actuator 130 is, for example, a piezoelectric actuator. The actuator 130 includes a first electrode 60, a piezoelectric layer 70, and a second electrode 80.

Generally, one of the electrodes of the actuator 130 is used as a common electrode, and the other electrode is patterned for each pressure chamber 12. In the present embodiment, the first electrode 60 is provided continuously over the plurality of actuators 130 to form a common electrode, and the second electrode 80 is provided independently for each actuator 130, thereby forming individual electrodes.

There is no problem even if this is reversed for convenience of the drive circuit or wiring. In the above example, the vibrating plate 50 is formed of the elastic film 51 and the insulating film 52, but it is of course not limited thereto. For example, either one of the elastic film 51 and the insulating film 52 may be provided as the vibrating plate 50, or the elastic film 51 and the insulating film 52 are not provided as the vibrating plate 50, and the first electrode 60 may act as a vibrating plate. In addition, the actuator 130 itself may also substantially function as the vibrating plate.

The piezoelectric layer 70 is formed of an oxide piezoelectric material having a polarized structure and can be formed of, for example, a perovskite type oxide represented by the general formula $ABO_3$, and can be formed of a lead-based piezoelectric material or a lead-free lead Based piezoelectric material or the like can be used.

The distal end of a lead electrode 90 is connected to the second electrode 80 which is an individual electrode of the actuator 130. The lead electrode 90 is drawn out from the vicinity of the end portion on the side opposite to the supply communicating path 19 and extends to the position above the vibrating plate 50. The lead electrode 90 is formed of, for example, gold (Au) or the like.

A wiring substrate 121 is connected to the other end portion of the lead electrode 90. As the wiring substrate 121, a flexible sheet-like material, for example, a COF substrate or the like can be used. The wiring substrate 121 is provided with a drive circuit 120 for driving the actuator 130.

As illustrated in FIG. 6, a second terminal row 123 is formed on one surface of the wiring substrate 121. The second terminal row 123 includes a plurality of second terminals (wiring terminals) 122 aligned in the Y axis direction. The wiring substrate 121 is not limited to the COF substrate, and may be FFC, FPC, or the like.

As illustrated in FIG. 5, the protective substrate 30 having substantially the same size as the flow path forming substrate 10 is joined to the surface of the flow path forming substrate 10 on the side of the actuator 130. The protective substrate 30 includes a holding portion 31 which is a space for protecting the actuator 130.

The holding portion 31 has a concave shape opening to the flow path forming substrate 10 side without penetrating the protective substrate 30 in the Z axis direction which is the thickness direction. The holding portion 31 is independently provided for each column composed of the actuators 130 juxtaposed in the X axis direction. That is, the holding portion 31 is provided so as to accommodate rows juxtaposed in the X axis direction of the actuator 130, and each row of the actuators 130, that is, two are arranged side by side in the Y axis direction. The holding portion 31 may have a space that does not hinder the movement of the actuator 130, and the space may be sealed or not sealed.

The protective substrate 30 has a through-hole 32 penetrating in the Z axis direction which is the thickness direction. The through-hole 32 is provided across the X axis direction, which is the juxtaposition direction of the plurality of actuators 130, between the two holding portions 31 juxtaposed in the Y axis direction. In other words, the through-hole 32 is an opening having long sides in the direction in which the plurality of actuators 130 are arranged. A proximal end of the lead electrode 90 is extended so as to be exposed in the through-hole 32, and the lead electrode 90 and the wiring substrate 121 are electrically connected in the through-hole 32.

As the protective substrate 30, it is preferable to use a material having substantially the same thermal expansion coefficient as that of the flow path forming substrate 10, for example, glass, a ceramic material, or the like. In this embodiment, the substrate is formed using a silicon single crystal substrate formed of the same material the flow path forming substrate 10. In addition, for example, in the present embodiment, the method of joining the flow path forming substrate 10 and the protective substrate 30 is not particularly limited, for example, the flow path forming substrate 10 and the protective substrate 30 are joined via an adhesive (not shown).

The head unit 2 includes the flow path forming member 40. The flow path forming member 40 defines the common liquid chamber 100 communicating with the plurality of pressure chambers 12 and the head main body 11. The flow path forming member 40 has substantially the same shape as the communicating plate 15 described above in the plan view, and is joined to the protective substrate 30 and also to the above-described communicating plate 15.

Specifically, the flow path forming member 40 has a concave portion 41 having a depth where the flow path forming substrate 10 and the protective substrate 30 are accommodated on the protective substrate 30 side. The concave portion 41 has an opening area larger than the surface of the protective substrate 30 bonded to the flow path forming substrate 10. With the flow path forming substrate 10 and the like accommodated in the concave portion 41, the opening surface of the concave portion 41 on the side of the nozzle plate 20 is sealed by the communicating plate 15. Accordingly, the third manifold portion 42 is defined on the outer peripheral portion of the flow path forming substrate 10 by the flow path forming member 40 and the head main body 11. The common liquid chamber 100 of the present embodiment is constituted of the first manifold portion 17 and the second manifold portion 18 provided in the communicating plate 15 and the third manifold portion 42 defined by the flow path forming member 40 and the head main body 11.

That is, the common liquid chamber 100 includes the first manifold portion 17, the second manifold portion 18, and the third manifold portion 42. The common liquid chamber 100 according to the present embodiment is disposed on both outer sides of the pressure chambers 12 in two rows in the Y axis direction and two common liquid chambers 100 provided on both outer sides of the pressure chambers 12 in two rows are independently provided so as not to communicate with each other in the head unit 2. That is, one common liquid chamber 100 is provided so as to communicate with each other in each row of the pressure chambers 12 (rows arranged in parallel in the X axis direction) of the present embodiment. In other words, a common liquid chamber 100 is provided for each nozzle row NL. The two common liquid chambers 100 may communicate with each other.

As described above, the flow path forming member 40 is a member forming the common liquid chamber 100, and has an introduction port 44 communicating with the common liquid chamber 100. That is, the introduction port 44 is an opening portion serving as an entrance for introducing the liquid supplied to the head main body 11 into the common liquid chamber 100. As the material of the flow path forming member 40, for example, resin, metal, or the like can be used. If the material of the flow path forming member 40 is a resin material, it can be mass-produced at low cost.

The flow path forming member 40 is provided with a connection port 43 communicating with the through-hole 32 of the protective substrate 30. The wiring substrate 121 is inserted through the connection port 43. The upper end portion of the wiring substrate 121 is extended in the penetrating direction of the through-hole 32 and the connection port 43, that is, in the Z axis direction, opposite to the direction in which the liquid droplet is ejected.

A compliance substrate 45 is provided on the surface of the communicating plate 15 on which the first manifold portion 17 and the second manifold portion 18 are opened. The compliance substrate 45 has substantially the same size as that of the above-described communicating plate 15 in plan view, and is provided with a first exposure opening 45*a* for exposing the nozzle plate 20. The opening of the first manifold portion 17 and the second manifold portion 18 on the nozzle surface 20*a* side is sealed in a state in which the compliance substrate 45 exposes the nozzle plate 20 by the first exposure opening 45*a*. That is, the compliance substrate 45 defines a part of the common liquid chamber 100.

The compliance substrate 45 includes a sealing film 46 and a fixed substrate 47. The sealing film 46 is formed of a filmy thin film having flexibility (for example, a thin film formed of polyphenylene sulfide (PPS) or the like and having a thickness of 20 μm or less). The fixed substrate 47 is formed of a hard material such as a metal such as stainless steel (SUS). Since the region of the fixed substrate 47 facing the common liquid chamber 100 is an opening 48 completely removed in the thickness direction, one surface of the common liquid chamber 100 is formed only of the flexible sealing film 46 and serves as a compliance portion 49 which is a flexible portion sealed with the above-described structure. In the present embodiment, one compliance portion 49 is provided corresponding to one common liquid chamber 100. That is, in the present embodiment, since two common liquid chambers 100 are provided, two compliance portions 49 are provided on both sides in the Y axis direction with the nozzle plate 20 interposed therebetween.

When ejecting the liquid droplets, the head unit 2 takes in liquid via the introduction port 44 and fills the inside of the flow path from the common liquid chamber 100 to the nozzle 21 with liquid. Thereafter, according to a signal from the drive circuit 120, a voltage is applied to the actuator 130 corresponding to the pressure chamber 12, thereby bending the vibrating plate 50 together with the actuator 130. As a result, the pressure in the pressure chamber 12 increases and the liquid droplets are ejected from the nozzle 21 communicating with the pressure chamber 12.

Regarding Configuration of Liquid Droplet Ejecting Head

Next, the liquid droplet ejecting head 1 will be described in detail.

As illustrated in FIG. 6, the liquid droplet ejecting head 1 includes four head units 2, a flow path member 200 that holds the head unit 2, a head substrate 300 held by the flow path member 200, a flexible wiring and a wiring substrate 121 which is an example of a substrate. The flow path member 200 includes a holder member for supplying liquid to the head unit 2.

Figure 7:
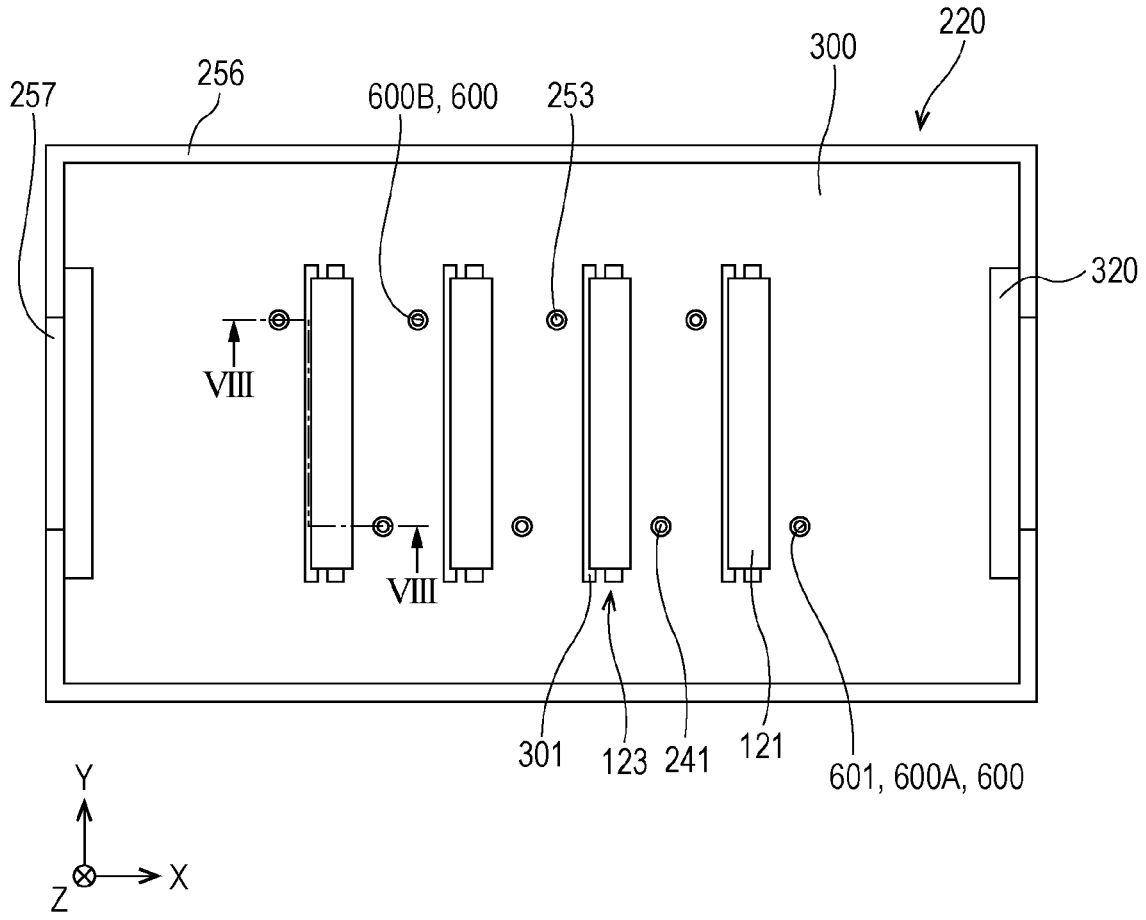
FIG. 7 is a plan view of the liquid droplet ejecting head in FIG. 6.

FIG. 7 is a plan view of the liquid droplet ejecting head 1 in which the sealing member 230 and the upstream flow path member 210 are not shown.

Figure 8:
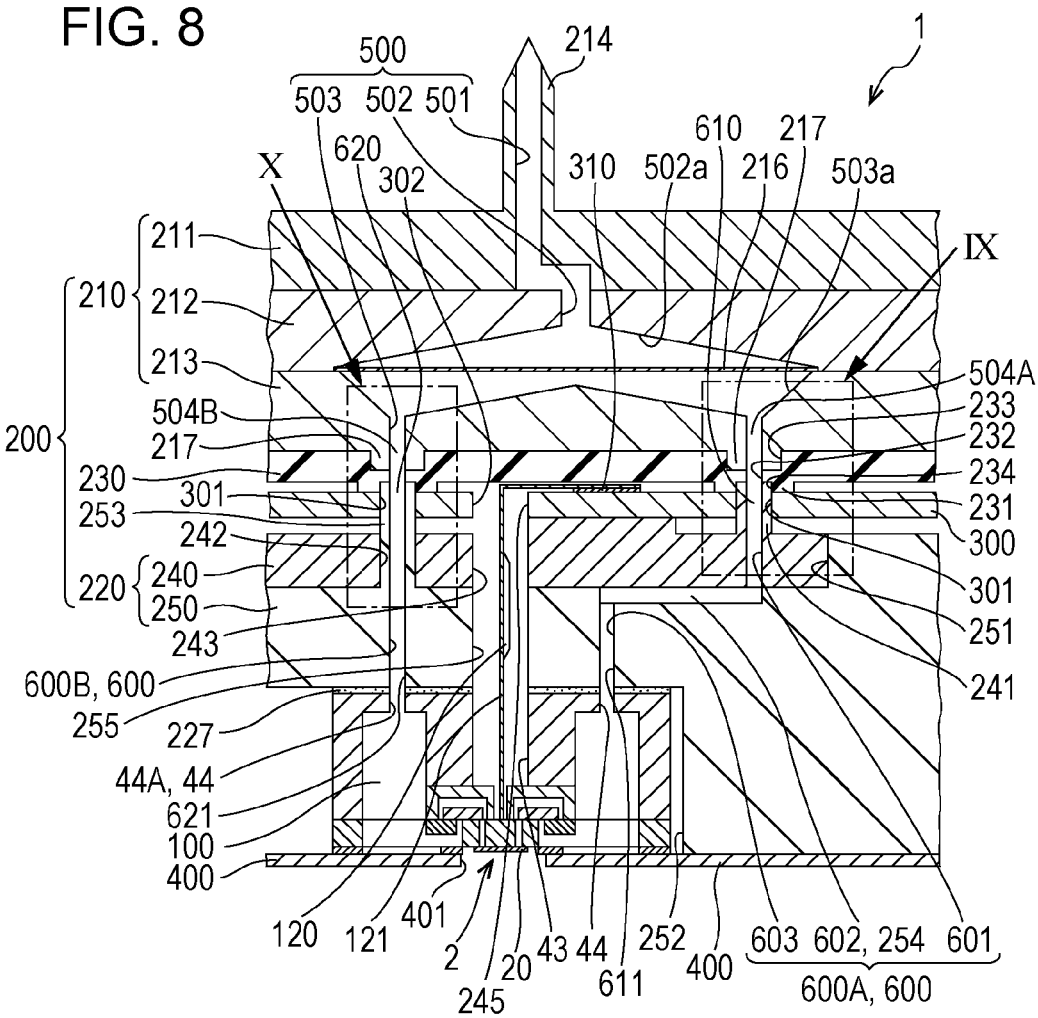
FIG. 8 is a cross-sectional view taken along line VIII-VIII in FIG. 7.

As illustrated in FIG. 8, the flow path member 200 includes an upstream flow path member 210, a downstream flow path member 220 that is an example of a holder member, and a sealing member 230 that is disposed between the upstream flow path member 210 and the downstream flow path member 220.

The upstream flow path member 210 includes an upstream flow path 500 serving as a liquid flow path. In the present embodiment, the upstream flow path member 210 is configured by staking a first upstream flow path member 211, a second upstream flow path member 212, and a third upstream flow path member 213 in the Z axis direction. A first upstream flow path 501, a second upstream flow path 502, and a third upstream flow path 503 are provided for each of these members, and the upstream flow path 500 is configured by connecting these members.

The upstream flow path member 210 is not limited to such an embodiment, and may be a single member or a plurality of two or more members. The stacking direction of the plurality of members constituting the upstream flow path member 210 is also not particularly limited, and may be the X axis direction and the Y axis direction.

The first upstream flow path member 211 includes a connection portion 214 connected to a liquid container such as a tank or a cartridge that stores liquid, on the side opposite to the downstream flow path member 220. In the present embodiment, the connection portion 214 is formed to protrude like a needle. A liquid accommodating portion such as a cartridge may be directly connected to the connection portion 214, or a liquid storage unit such as a tank may be connected via a supply pipe or the like such as a tube or the like.

The first upstream flow path member 211 is provided with a first upstream flow path 501. The first upstream flow path 501 opens to the top surface of the connection portion 214 and is configured of a flow path extending in the Z axis direction and a flow path extending in the direction orthogonal to the Z axis direction, that is a flow path extending in a plane including the X axis direction and the Y axis direction, and the like according to the position of the second upstream flow path 502 to be described below. A guide wall 215 (see FIG. 6) for positioning the liquid holding portion is provided around the connection portion 214 of the first upstream flow path member 211.

The second upstream flow path member 212 includes the second upstream flow path 502 fixed to the side opposite to the connection portion 214 of the first upstream flow path member 211 and communicating with the first upstream flow path 501. A first liquid reservoir portion 502*a* having an inner diameter wider than that of the second upstream flow path 502 and widening is provided on the downstream side of the second upstream flow path 502 (on the third upstream flow path member 213 side).

The third upstream flow path member 213 is provided on the side of the second upstream flow path member 212 opposite to the first upstream flow path member 211. The third upstream flow path member 213 is provided with a third upstream flow path 503. An opening portion of the third upstream flow path 503 on the second upstream flow path 502 side is a second liquid reservoir portion 503*a* which is widened according to the first liquid reservoir portion 502*a*. A filter 216 for removing foreign matters such as air bubbles contained in the liquid is provided at the opening portion (between the first liquid reservoir portion 502*a* and the second liquid reservoir portion 503*a*) of the second liquid reservoir portion 503*a*. Accordingly, the liquid supplied from the second upstream flow path 502 (the first liquid reservoir portion 502*a*) is supplied to the third upstream flow path 503 (the second liquid reservoir portion 503*a*) via the filter 216.

As the filter 216, for example, a net-like body such as a wire mesh or a resin net, a porous body, or a metal plate having a fine penetration hole formed therein can be used. Specific examples of the reticulated body include a metal mesh filter or a metal fiber, for example, a felted thin wire of SUS, a sintered metal sintered filter, an electroforming metal filter, an electron beam processing a metal filter, a laser beam processing metal filter, or the like can be used.

As a property of the filter 216, it is preferable that the air bubble point pressure does not vary, and a filter having a high-precision hole diameter is suitable. The "bubble point pressure" refers to the pressure at which the meniscus formed at the filter pore breaks. The filtration particle size of the filter 216 is preferably smaller than the diameter of the nozzle opening when, for example, the nozzle opening is circular, in order to prevent foreign matter in the liquid from reaching the nozzle opening.

In the case where a mesh filter of stainless steel is adopted as the filter 216, foreign matters in the liquid should not reach the nozzle opening. Therefore, it is preferable for the mesh filter to have a twill weave (filtering grain size of 10 μm) in which the filtering particle size is smaller than the nozzle opening (for example, when the nozzle opening is circular, the diameter of the nozzle opening is 20 μm). In this case, the air bubble point pressure generated with the liquid (surface tension 28 mN/m) is 3 to 5 kPa. In addition, the air bubble point pressure generated by liquid when using twill weave (filtration particle size 5 μm) is 0 to 15 kPa.

The third upstream flow path 503 is branched into two at the downstream side (the side opposite to the second upstream flow path) than the second liquid reservoir portion 503*a*, and opens as a first discharge port 504A and a second discharge port 504B on the surface of the third upstream flow path member 213 on the downstream flow path member 220 side. Hereinafter, when the first discharge port 504A and the second discharge port 504B are not distinguished, they are referred to as a discharge port 504.

That is, the upstream flow path 500 corresponding to one connection portion 214 includes the first upstream flow path 501, the second upstream flow path 502, and the third upstream flow path 503, and the upstream flow path 500 opens the downstream flow path member 220 as two discharge ports 504 (a first discharge port 504A and a second discharge port 504B). In other words, the two discharge ports 504 (the first discharge port 504A and the second discharge port 504B) are provided in communication with a common flow path.

A third protrusion 217 protruding toward the downstream flow path member 220 side is provided on the downstream flow path member 220 side of the third upstream flow path member 213. The third protrusion 217 is provided for each third upstream flow path 503, and the discharge port 504 is provided on the distal end face of the third protrusion 217 so as to open.

The first upstream flow path member 211, the second upstream flow path member 212, and the third upstream flow path member 213 provided with such an upstream flow path 500 are integrally stacked by, for example, an adhesive, welding, or the like. Although the first upstream flow path member 211, the second upstream flow path member 212, and the third upstream flow path member 213 can be fixed by screws, clamps, or the like, it is preferable to fix the first upstream flow path member 211, the second upstream flow path member 212, and the third upstream flow path member 213 with adhesives, welding or the like in order to suppress the leakage of liquid from the connection portion from the first upstream flow path 501 to the third upstream flow path 503.

In the present embodiment, one upstream flow path members 210 are provided with four connection portions 214, and one upstream flow path member 210 is provided with four independent upstream flow paths 500. The liquid is supplied to each of the four head units 2 in each upstream flow path 500. One upstream flow path 500 branches into two and communicates with a downstream flow path 600 to be described later and is connected to each of the two introduction ports 44 of the head unit 2.

In the present embodiment, the configuration in which the upstream flow path 500 is branched into two at the downstream side (the downstream flow path member 220 side) than the filter 216 is exemplified. However, the invention is not particularly limited thereto, and the upstream flow path 500 may be branched into three or more than the filter 216. In addition, one upstream flow path 500 may not be branched downstream from the filter 216.

The downstream flow path member 220 is an example of a holder member joined to the upstream flow path member 210 and having a downstream flow path 600 communicating with the upstream flow path 500. The downstream flow path member 220 according to the present embodiment includes a first downstream flow path member 240 which is an example of a first member and a second downstream flow path member 250 which is an example of a second member.

The downstream flow path member 220 has a downstream flow path 600 that is a liquid flow path. The downstream flow path 600 according to the present embodiment includes two types of downstream flow paths 600A and 600B having different shapes.

The first downstream flow path member 240 is a member formed in a substantially flat plate shape. In addition, the second downstream flow path member 250 is provided with a first accommodating portion 251 as a concave portion on the surface on the side of the upstream flow path member 210 and a second accommodating portion 252 as a concave portion on the surface on the side opposite to the upstream flow path member 210.

The first accommodating portion 251 has a size to accommodate the first downstream flow path member 240. In addition, the second accommodating portion 252 has a size to accommodate four head units 2. The second accommodating portion 252 according to the present embodiment can accommodate four head units 2.

A plurality of first protrusions 241 are formed on the surface of the first downstream flow path member 240 on the side of the upstream flow path member 210. Each of the first protrusions 241 is provided to face the third protrusion 217 provided with the first discharge port 504A among the third protrusions 217 provided in the upstream flow path member 210. In the present embodiment, four first protrusions 241 are provided.

The first downstream flow path member 240 is provided with a first flow path 601 penetrating in the Z axis direction and opening on the top surface of the first protrusion 241 (the surface facing the upstream flow path member 210). The third protrusion 217 and the first protrusion 241 are joined via the sealing member 230, and the first discharge port 504A and the first flow path 601 communicate with each other.

A plurality of second through-holes 242 penetrating in the Z axis direction are formed in the first downstream flow path member 240. Each of the second through-holes 242 is formed at a position where the second protrusion 253 formed in the second downstream flow path member 250 is inserted. In the present embodiment, four second through-holes 242 are provided.

A plurality of first insertion holes 243 through which the wiring substrate 121 electrically connected to the head unit 2 is inserted is formed in the first downstream flow path member 240. Specifically, each of the first insertion holes 243 penetrates in the Z axis direction and is formed so as to communicate with a second insertion hole 255 of the second downstream flow path member 250 and a third insertion hole 302 of the head substrate 300. In the present embodiment, four first insertion holes 243 are provided corresponding to the respective wiring substrates 121 provided in the four head units 2. In addition, the first downstream flow path member 240 is provided with a support portion 245 which protrudes toward the head substrate 300 and has a receiving surface.

In the second downstream flow path member 250, a plurality of second protrusions 253 are formed on the bottom surface of the first accommodating portion 251. Each of the second protrusions 253 is provided to face the third protrusion 217 provided with the second discharge port 504B of the third protrusion 217 provided in the upstream flow path member 210. In the present embodiment, four second protrusions 253 are provided. In addition, the second downstream flow path member 250 is provided with a downstream flow path that penetrates in the Z axis direction and opens to the top surface of the second protrusion 253 and the bottom surface of the second accommodating portion 252 (the surface facing the head unit 2) 600B are provided. The third protrusion 217 and the second protrusion 253 are joined via the sealing member 230, and the second discharge port 504B and the downstream flow path 600B communicate with each other.

A plurality of third flow paths 603 penetrating in the Z axis direction are formed in the second downstream flow path member 250. Each of the third flow paths 603 opens to the bottom surfaces of the first accommodating portion 251 and the second accommodating portion 252. In the present embodiment, four third flow paths 603 are provided.

A plurality of groove portions 254 continuous with the third flow path 603 are formed in the bottom surface of the first accommodating portion 251 of the second downstream flow path member 250. The groove portion 254 forms a second flow path 602 by being sealed in the first downstream flow path member 240 stored in the first accommodating portion 251. That is, the second flow path 602 is a flow path defined by the groove portion 254 and the surface of the first downstream flow path member 240 on the side of the second downstream flow path member 250. The second flow path 602 corresponds to a flow path provided between the first member and the second member described in the claims.

A plurality of second insertion holes 255 through which the wiring substrate 121 electrically connected to the head unit 2 is inserted is formed in the second downstream flow path member 250. Specifically, each of the second insertion holes 255 penetrates in the Z axis direction and is formed so as to communicate with the first insertion hole 243 of the first downstream flow path member 240 and the connection port 43 of the head unit 2. In the present embodiment, four second insertion holes 255 are provided corresponding to the respective wiring substrates 121 provided in the four head units 2.

The downstream flow path 600A is formed by communicating the above-described first flow path 601, second flow path 602, and third flow path 603. Here, the second flow path 602 is formed by sealing a groove formed on one surface of the first downstream flow path member 240 with the second downstream flow path member 250. By joining the first downstream flow path member 240 and the second downstream flow path member 250 as described above, it is possible to easily form the second flow path 602 in the downstream flow path member 220.

The second flow path 602 is an example of a flow path extending in the horizontal direction. The matter that the second flow path 602 extends in the horizontal direction means that a component (vector) in the X axis direction or the Y axis direction is included in the extending direction of the second flow path 602. Since the second flow path 602 extends in the horizontal direction, it is possible to reduce the height of the liquid droplet ejecting head 1 in the Z axis direction. If the second flow path 602 is inclined with respect to the horizontal direction, the height dimension of the liquid droplet ejecting head 1 is increased.

The extending direction of the second flow path 602 is the direction in which the liquid flows in the second flow path 602. Therefore, the second flow path 602 may be provided in the horizontal direction (the direction orthogonal to the Z axis direction) also in the gravitational direction and the horizontal direction (the in-plane direction in the X axis direction and the Y axis direction). In the present embodiment, the first flow path 601 and the third flow path 603 are arranged in the Z axis direction, and the second flow path 602 is arranged in the horizontal direction (Y axis direction). The first flow path 601 and the third flow path 603 may be arranged in the axial direction crossing the Z axis.

The downstream flow path 600A is not limited to this, and flow paths other than the first flow path 601, the second flow path 602, and the third flow path 603 may exist. In addition, the downstream flow path 600A does not include the first flow path 601, the second flow path 602, and the third flow path 603, and may be configured with one flow path.

As described above, the downstream flow path 600B is formed as a through-hole penetrating the second downstream flow path member 250 in the Z axis direction. The downstream flow path 600B is not limited to such a state, and may extend in the axial direction crossing the Z axis, for example, or may be configured by communicating a plurality of flow paths like the downstream flow path 600A.

One such downstream flow path 600A and one downstream flow path 600B are formed for each head unit 2. That is, in the downstream flow path member 220, a total of four pairs of the downstream flow path 600A and the downstream flow path 600B are provided.

Among the openings at both ends of the downstream flow path 600A, the opening of the first flow path 601 with which the first discharge port 504A communicates is set as a first inflow port 610, and the opening of the third flow path 603 that opens to the second accommodating portion 252 is set as a first outlet port 611.

The opening of the downstream flow path 600B communicating with the second discharge port 504B among the openings at both ends of the downstream flow path 600B is set as a second inflow port 620 and the opening of the downstream flow path 600B that opens to the second accommodating portion 252 is set as a second outlet port 621. Hereinafter, in a case where the downstream flow path 600A and the downstream flow path 600B are not distinguished, they are referred to as a downstream flow path 600.

As illustrated in FIG. 6, the downstream flow path member 220 (holder member) holds the head unit 2 on the lower side. Specifically, a plurality of (four in the present embodiment) head units 2 are stored in the second accommodating portion 252 of the downstream flow path member 220.

As illustrated in FIG. 8, two introduction ports 44 are provided in the head unit 2. The first outlet port 611 and the second outlet port 621 of the downstream flow path 600 (the downstream flow path 600A and the downstream flow path 600B) are provided in the downstream flow path member 220 in accordance with the positions where the introduction ports 44 are opened.

Each of the introduction ports 44 of the head unit 2 are aligned so as to communicate with the first outlet port 611 and the second outlet port 621 of the downstream flow path 600 opened in the bottom face portion of the second accommodating portion 252. The head unit 2 is fixed to the second accommodating portion 252 by an adhesive agent 227 provided around each introduction port 44. By fixing the head unit 2 to the second accommodating portion 252, the first outlet port 611 and the second outlet port 621 of the downstream flow path 600 communicate with the introduction port 44, and the liquid is supplied to the head unit 2.

In the downstream flow path member 220, the head substrate 300 is mounted on the upper side. Specifically, the head substrate 300 is mounted on the surface of the downstream flow path member 220 on the side of the upstream flow path member 210. The head substrate 300 is a member to which the wiring substrate 121 is connected and which is mounted with a circuit for controlling the ejecting operation or the like of the liquid droplet ejecting head 1 via the wiring substrate 121 or an electrical component such as a resistor.

As illustrated in FIG. 6, on the surface of the upstream flow path member 210 side of the head substrate 300, a first terminal row 310 in which a plurality of first terminals (electrode terminals) 311 to which the second terminal row 123 of the wiring substrate 121 is electrically connected is formed in parallel is formed. In the present embodiment, the first terminal row 310, as an example of mounting region electrically connected to the wiring substrate 121.

A plurality of third insertion holes 302 through which the wiring substrate 121 electrically connected to the head unit 2 is inserted are formed in the head substrate 300. Specifically, each third insertion hole 302 penetrates in the Z axis direction and is formed so as to communicate with the first insertion hole 243 of the first downstream flow path member 240. In the present embodiment, four third insertion holes 302 are provided corresponding to the respective wiring substrates 121 provided in the four head units 2.

The head substrate 300 is provided with a third through-hole 301 penetrating in the Z axis direction. In the third through-hole 301, the first protrusion 241 of the first downstream flow path member 240 and the second protrusion 253 of the second downstream flow path member 250 are inserted. In the present embodiment, a total of eight third through-holes 301 are provided so as to face the first protrusion 241 and the second protrusion 253.

The shape of the third through-hole 301 formed in the head substrate 300 is not limited to the above-described embodiment. For example, a common through-hole through which the first protrusion 241 and the second protrusion 253 are inserted may be used as the insertion hole. That is, the insertion holes, notches, and the like may be formed on the head substrate 300 so as not to obstruct connection between the downstream flow path 600 of the downstream flow path member 220 and the upstream flow path 500 of the upstream flow path member 210.

Figure 9:
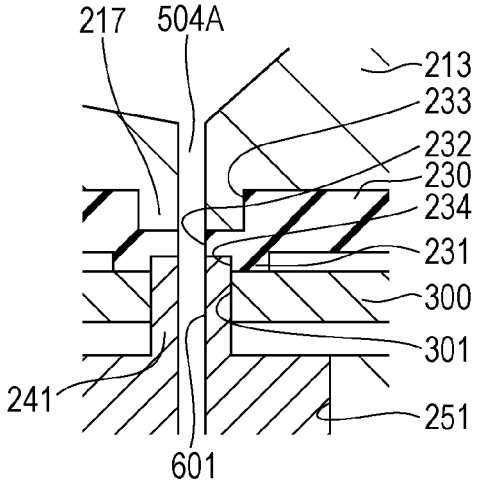
FIG. 9 is an enlarged view of a right-side one-dot chain line frame in FIG. 8.
Figure 10:
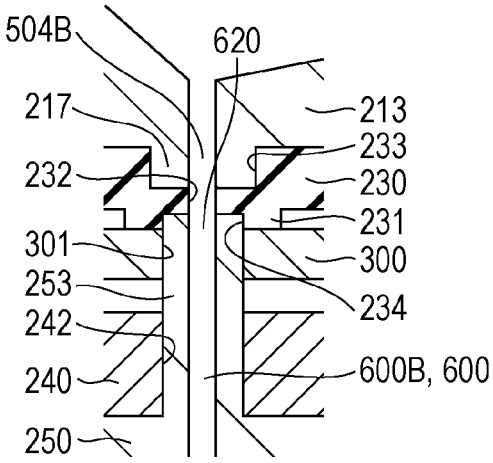
FIG. 10 is an enlarged view of a left-side one-dot chain line frame in FIG. 8.

As illustrated in FIGS. 8, 9, and 10, the sealing member 230 is provided between the head substrate 300 and the upstream flow path member 210. As the material of the sealing member 230, it is possible to use a material (elastic material) having liquid resistance against a liquid such as ink used for the liquid droplet ejecting head 1 and being elastically deformable, for example, rubber, elastomer or the like.

The sealing member 230 is a plate-like member in which a communicating path 232 penetrating in the Z axis direction and a fourth protrusion 231 protruding toward the downstream flow path member 220 side are formed. In the present embodiment, eight communicating paths 232 and fourth protrusions 231 are formed corresponding to each of the upstream flow path 500 and the downstream flow path 600.

An annular first concave portion 233 into which the third protrusion 217 is inserted is provided on the upstream flow path member 210 side of the sealing member 230. The first concave portion 233 is provided at a position facing the fourth protrusion 231.

The fourth protrusion 231 protrudes toward the downstream flow path member 220 and is provided at a position facing the first protrusion 241 and the second protrusion 253 of the downstream flow path member 220. A second concave portion 234 into which the first protrusion 241 and the second protrusion 253 are inserted is provided on the top surface of the fourth protrusion 231 (the surface facing the downstream flow path member 220).

The communicating path 232 penetrates the sealing member 230 in the Z axis direction, one end opens to the first recess 233, and the other end opens to a second concave portion 234. The fourth protrusion 231 is held in a state where a predetermined pressure is applied in the Z axis direction between the distal end surface of the third protrusion 217 inserted into the first recess 233 and the distal end surfaces of the first protrusion 241 and the second protrusion 253 inserted into the second concave portion 234. Therefore, the upstream flow path 500 and the downstream flow path 600 are communicated in a sealed state via the communicating path 232.

A cover head 400 is attached to the second accommodating portion 252 side (lower side) of the downstream flow path member 220. The cover head 400 is a member to which the liquid droplet ejecting head 1 is fixed and fixed to the downstream flow path member 220, and a second exposure opening 401 exposing the nozzle 21 is provided. In the present embodiment, the second exposure opening 401 has a size to expose the nozzle plate 20, that is, an opening substantially the same as the first exposure opening 45*a* of the compliance substrate 45.

The cover head 400 is joined to the side of the compliance substrate 45 opposite to the communicating plate 15, and seals the space on the opposite side of the flow path (the common liquid chamber 100) of the compliance portion 49. By covering the compliance portion 49 with the cover head 400 as described above, destruction of the compliance portion 49 can be suppressed even when the compliance portion 49 contacts the medium ST. In addition, it is possible to prevent the liquid from adhering to the compliance portion 49 and to wipe off the surface of the cover head 400 to which liquid is adhered with, for example, a wiper blade or the like, so as to soil the medium ST with the liquid or the like adhering to the cover head 400. Although not specifically shown, the space between the cover head 400 and the compliance portion 49 is open to the atmosphere. The cover head 400 may be independently provided for each liquid droplet ejecting head 1.

Regarding Electrical Configuration of Liquid Droplet Ejecting Apparatus

Next, the electrical configuration of the liquid droplet ejecting apparatus 700 will be described.

Figure 11:
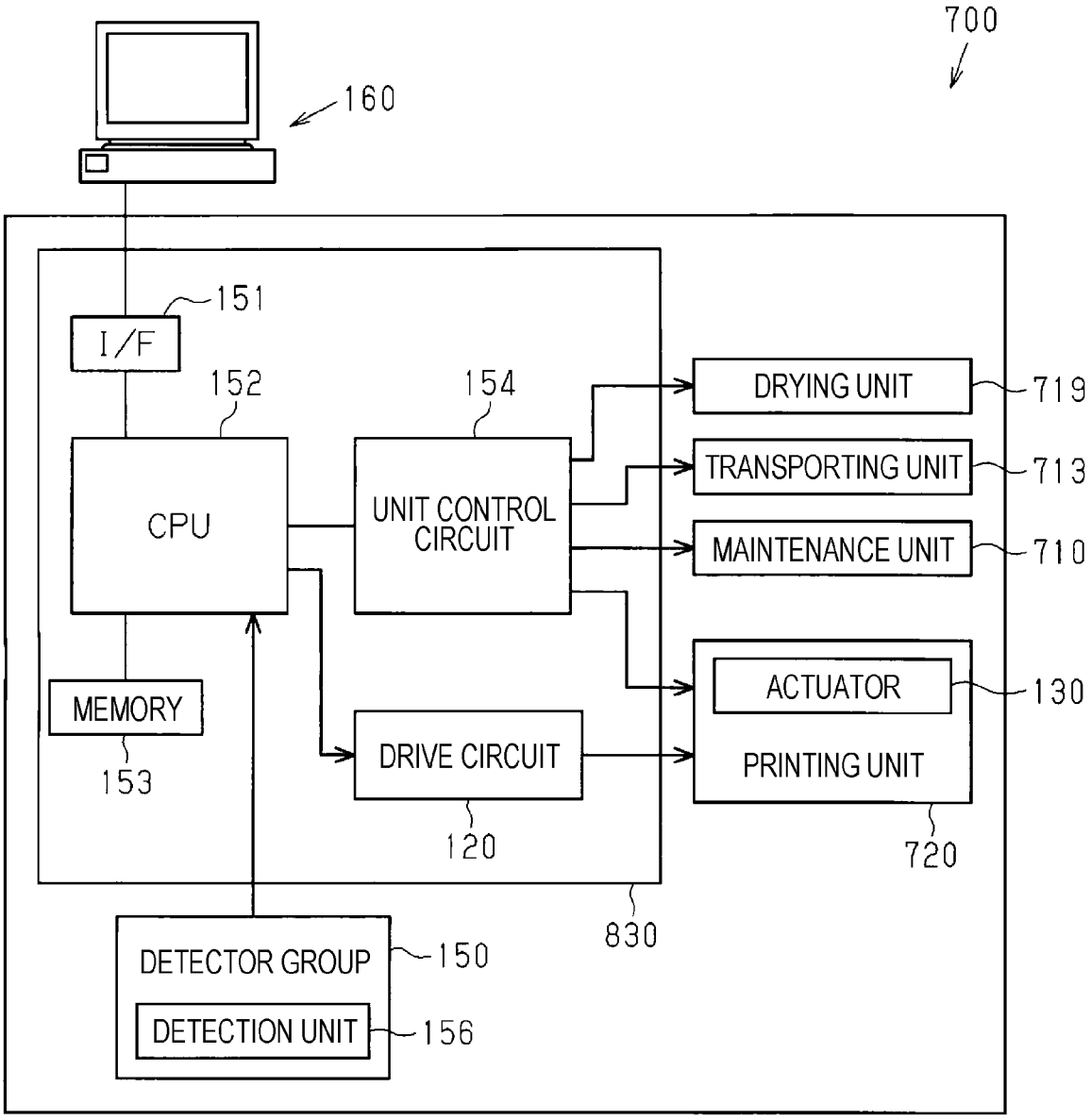
FIG. 11 is a block diagram illustrating an electrical configuration of the liquid droplet ejecting apparatus in FIG. 1.

As illustrated in FIG. 11, the liquid droplet ejecting apparatus 700 includes a control unit 830 that comprehensively controls the components of the liquid droplet ejecting apparatus 700, a detector group 150 that monitors the state in the liquid droplet ejecting apparatus 700. The detector group 150 outputs the detection result to the control unit 830.

The control unit 830 includes an interface unit 151, a CPU 152, a memory 153, a unit control circuit 154, and the drive circuit 120. The interface unit 151 transmits and receives data between a computer 160 which is an external device and the liquid droplet ejecting apparatus 700. The drive circuit 120 generates a driving signal for driving the actuator 130.

The CPU 152 is an arithmetic processing unit. The memory 153 is a storage device for securing an area for storing the program of the CPU 152, a work area, or the like, and includes a storage element such as RAM, EEPROM or the like. The CPU 152 controls the drying unit 719, the transporting unit 713, the maintenance unit 710, and the printing unit 720 via the unit control circuit 154 in accordance with a program stored in the memory 153.

The detector group 150 includes, for example, a linear encoder (not shown) for detecting the movement state of the carriage 723, a medium detection sensor (not shown) for detecting the medium ST, and a detection unit 156 that is a circuit for detecting residual vibration of the pressure chamber 12 is included. The control unit 830 performs the nozzle inspection to be described later based on the detection result of the detection unit 156. The detection unit 156 may include a piezoelectric element constituting the actuator 130.

Regarding Nozzle Inspection

A signal from the drive circuit 120 is received and a voltage is applied to the actuator 130, the vibrating plate 50 flexes and deforms. As a result, a pressure fluctuation occurs in the pressure chamber 12, and the vibrating plate 50 vibrates for a while due to the fluctuation. This vibration is referred to as residual vibration, and detection of the state of the nozzle 21 communicating with the pressure chamber 12 and the pressure chamber 12 from the state of residual vibration is referred to as nozzle inspection.

Figure 12:
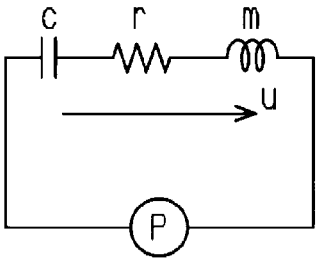
FIG. 12 is a diagram illustrating a calculation model of a simple vibration assuming residual vibration of a vibrating plate.

FIG. 12 is a view illustrating a calculation model of a simple vibration assuming residual vibration of the vibrating plate 50.

When the drive circuit 120 applies a drive signal to the actuator 130, the actuator 130 expands or contracts according to the voltage of the drive signal. The vibrating plate 50 bends according to expansion and contraction of the actuator 130, whereby the volume of the pressure chamber 12 expands and then contracts. At this time, a part of the liquid (ink) filling the pressure chamber 12 is ejected as liquid droplets from the nozzle 21 by the pressure generated in the pressure chamber 12.

When the series of vibrating plates 50 are operated, the natural vibration determined by a flow path resistance r due to the shape of the ink supply port, ink thickening, or the like, an inertance m due to the ink weight in the flow path, and a compliance C of the vibrating plate 50 at the frequency, the vibrating plate 50 freely vibrates (residual vibration).

The calculation model of the residual vibration of the vibrating plate 50 can be expressed by a pressure P, the inertance m, the compliance C, and a flow path resistance r described above. A step response when the pressure P is applied to the circuit in FIG. 12 is calculated with respect to a volumetric velocity u, the following equation is obtained.

$$u = \frac{P}{\omega \cdot m} e^{-\omega t} \cdot \sin \omega t \tag{1}$$

$$\omega = \sqrt{\frac{1}{m \cdot C} - \alpha^2} \tag{2}$$

$$\alpha = \frac{r}{2m} \tag{3}$$

Figure 13:
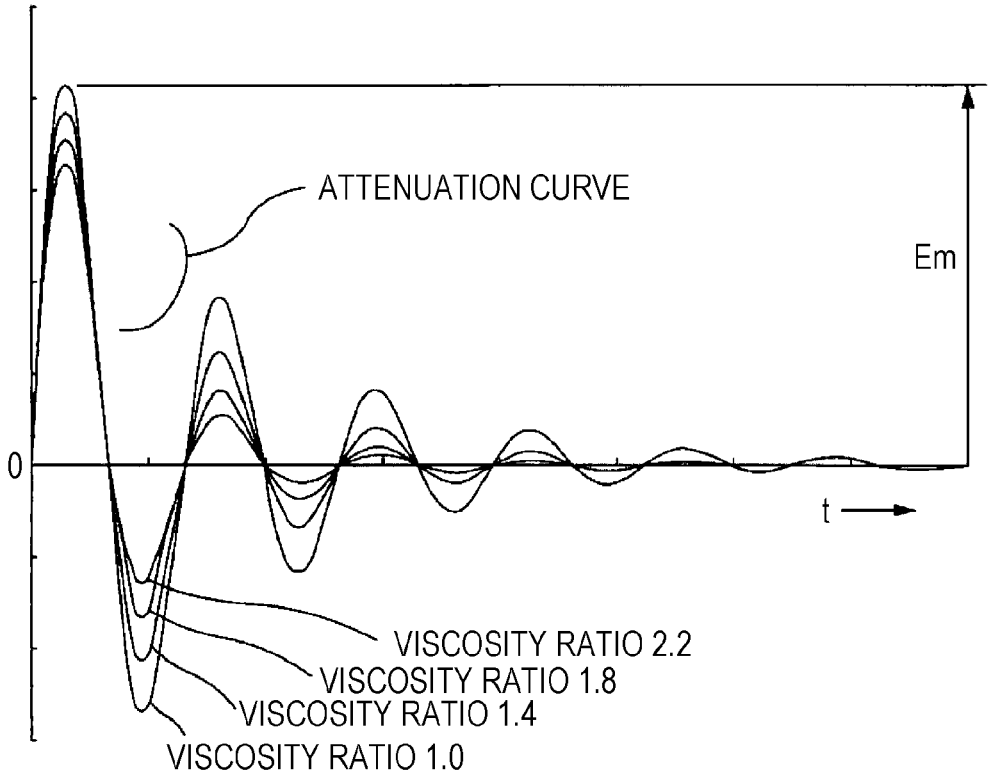
FIG. 13 is an explanatory view for illustrating a relationship between thickening of ink and residual vibration waveform.

FIG. 13 is an explanatory diagram of the relationship between thickening of ink and residual vibration waveform. In FIG. 13, a horizontal axis represents time and a vertical axis represents magnitude of residual vibration. For example, in a case where the ink in the vicinity of the nozzle 21 is dried, the thickening of the ink increases (thickens). When the ink thickens, since the flow path resistance r increases, damping of the vibration period and residual vibration increases.

Figure 14:
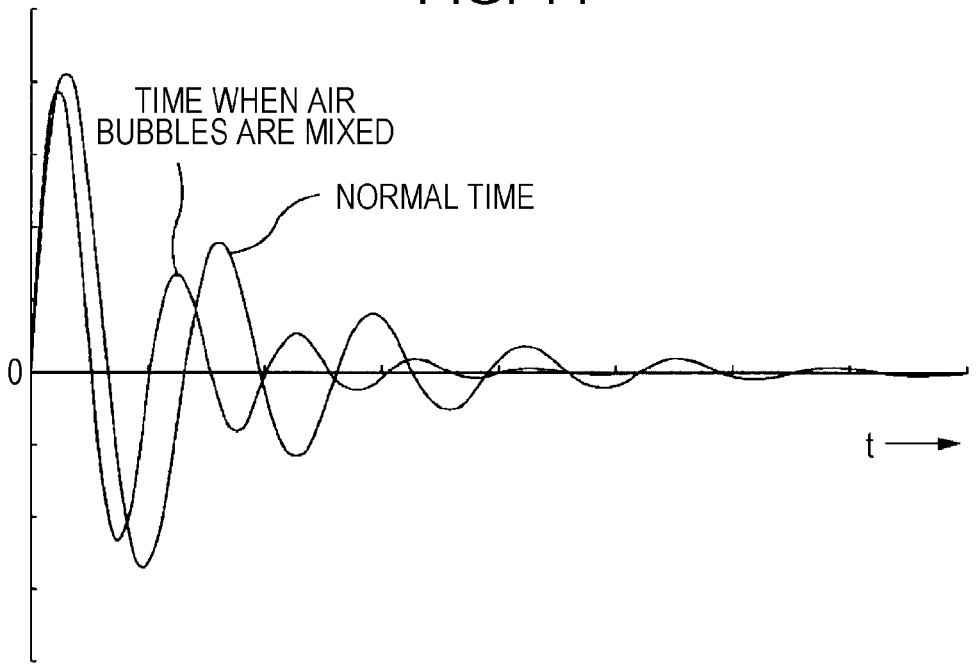
FIG. 14 is an explanatory view for illustrating the relationship between air bubbles inclusion and residual vibration waveform.

FIG. 14 is an explanatory diagram of the relationship between bubble inclusion and residual vibration waveform. In FIG. 14, the horizontal axis represents the time and the vertical axis represents the magnitude of residual vibration. For example, when the air bubbles are mixed in the flow path of the ink or the tip of the nozzle 21, the ink weight (=inertance m) decreases by the amount of air bubbles mixed as compared with the state of the nozzle 21 in a normal state. When m decreases from Equation (2), the angular velocity co becomes large, so the vibration cycle becomes short (the vibration frequency increases).

In addition to this, when foreign matter such as paper dust adheres to the vicinity of the opening of the nozzle 21, it is considered that the inertance m increases as the ink in the pressure chamber 12 and the oozing out as seen from the vibrating plate 50 increases more than in the normal state. In addition, it is also considered that the flow path resistance r increases due to the fibers of the paper dust adhering to the vicinity of the outlet of the nozzle 21. Therefore, when the paper dust adheres to the vicinity of the opening of the nozzle 21, the frequency is lower than that at the time of normal ejecting, and the frequency of residual vibration is higher than in the case of ink thickening.

When the thickening of the ink, mixing of bubbles, sticking of foreign matter, or the like occurs, since the state in the nozzle 21 or the pressure chamber 12 is not normal, that ink is not typically ejected from the nozzle 21. Therefore, dot missing occurs in the image printed on the medium ST. Even when ink droplets are ejected from the nozzles 21, the amount of ink droplets may be small, or the flight direction of the ink droplets may deviate and may not land on a target position in some cases. The nozzle 21 in which such ejecting failure occurs is referred to as an abnormal nozzle.

As described above, the residual vibration of the pressure chamber 12 communicating with the abnormal nozzle is different from the residual vibration of the pressure chamber 12 communicating with the normal nozzle 21. Therefore, the detection unit 156 detects the state in the pressure chamber 12 by detecting the vibration waveform of the pressure chamber 12, and the control unit 830 inspects the nozzle 21 based on the detection result of the detection unit 156. In addition, the maintenance unit 710 performs maintenance for eliminating ejecting failure based on the result of the nozzle inspection.

Regarding Configuration of Maintenance Unit

Next, the configuration of the maintenance unit 710 will be described.

Figure 15:
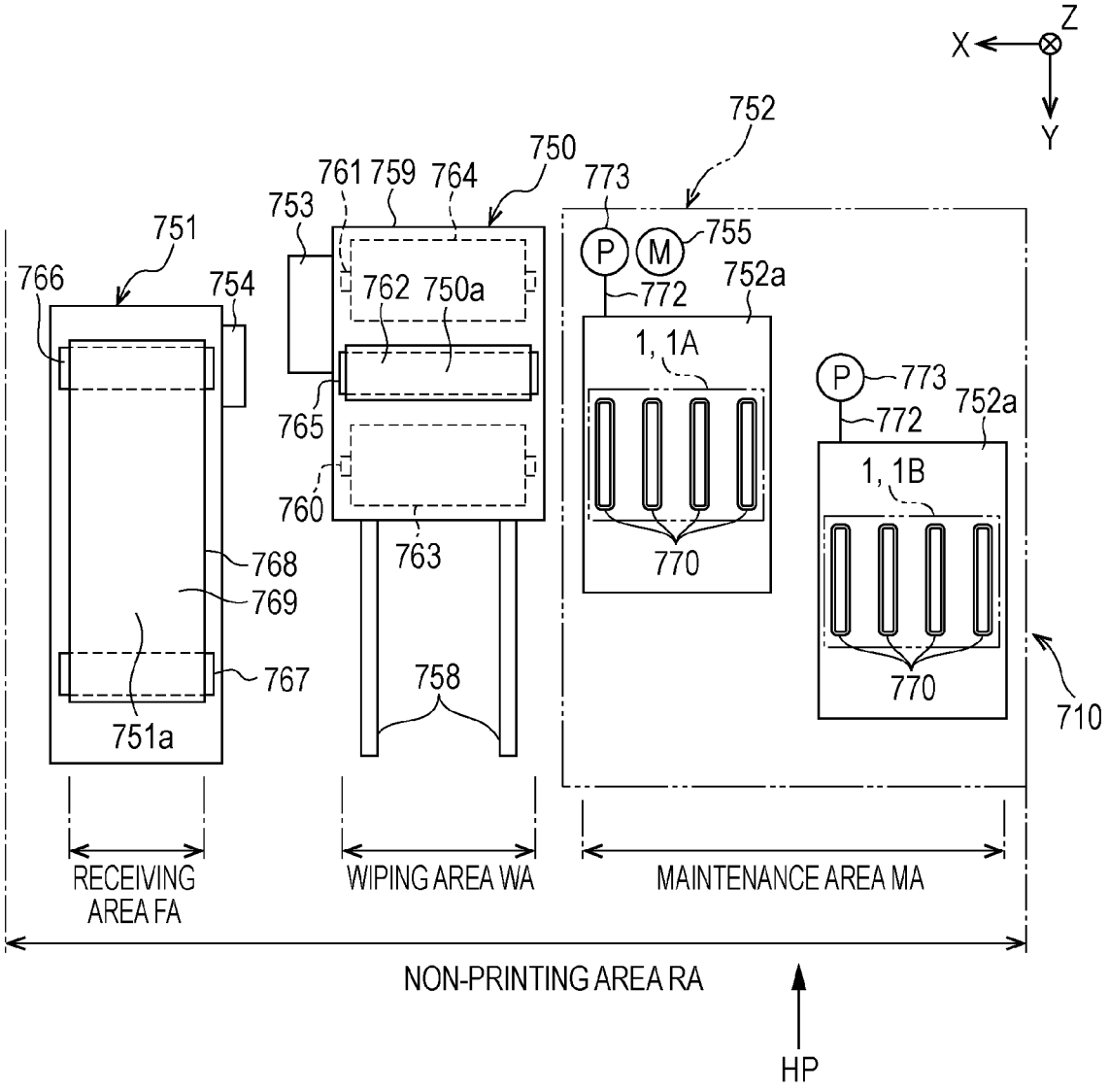
FIG. 15 is a plan view of a maintenance unit of the liquid droplet ejecting apparatus in FIG. 1.

As illustrated in FIG. 15, the non-printing area RA includes a receiving area FA where the liquid receiving mechanism 751 is provided, a wiping area WA provided with the wiping mechanism 750, and a maintenance area MA provided with the cap mechanism 752. In the non-printing area RA, the receiving area FA is disposed at a position closest to the printing area PA, and the maintenance area MA is arranged at a position farthest from the printing area PA.

The wiping mechanism 750 includes a wiping member 750*a* for wiping the liquid droplet ejecting head 1 and a wiping motor 753. The wiping member 750*a* of the present embodiment is movable, and wipes the liquid droplet ejecting head 1 with the power of the wiping motor 753. Such maintenance by wiping is called wiping.

The wiping mechanism 750 includes a pair of rails 758 extending in the Y axis direction by the power of the wiping motor 753 and a movable case 759 supported by the rail 758. The power of the wiping motor 753 is transmitted in the case 759 by a power transmission mechanism (not shown) (for example, a rack and pinion mechanism) and reciprocates on the rail 758 by the power thereof.

The case 759 rotatably supports a feeding shaft 760, a pressing roller 765, and a winding shaft 761 arranged at a predetermined interval in the Y axis direction. The case 759 includes an opening (not shown) above the pressing roller 765.

The feeding shaft 760 supports a feeding roll 763 in which an unused cloth sheet 762 is wound in a cylindrical shape, and the winding shaft 761 supports a winding roll 764 formed by a used cloth sheet 762. The pressing roller 765 pushes up a cloth sheet 762 between the feeding roll 763 and the winding roll 764 to protrude from the opening portion.

The case 759 moves forward in the Y axis direction from a retracted position illustrated in FIG. 15 by the normal rotation of the wiping motor 753, and reaches the wiping position. Thereafter, the case 759 moves backward from the wiping position to the retreat position by the reverse rotation of the wiping motor 753. In the process of the forward movement of the case 759, the wiping member 750*a* wipes the liquid droplet ejecting head 1.

When the forward movement of the case 759 is completed, the power transmission mechanism switches the output destination of the driving force of the wiping motor 753 to the winding shaft 761, and the return movement of the case 759 and the backward movement of the case 759 by the power when the wiping motor 753 is driven in reverse may be performed and the cloth sheet 762 may be wound up.

The case 759 wipes one liquid droplet ejecting head 1 by one reciprocating movement and completes wiping of the two liquid droplet ejecting heads 1A and 1B by reciprocating twice.

The liquid receiving mechanism 751 includes a liquid receiving portion 751*a* for receiving the liquid droplets ejected by the liquid droplet ejecting head 1 and a flushing motor 754. The term flushing refers to maintenance in which the liquid droplet ejecting head 1 discharges a liquid as a waste liquid for the purpose of preventing and eliminating clogging of the nozzle 21. The liquid receiving portion 751*a* of the present embodiment is a belt, and the belt is moved by the power of the flushing motor 754 at a time when it can be considered that the amount of ink contamination due to flushing of the belt exceeds a specified amount.

The liquid receiving mechanism 751 includes a driving roller 766, a driven roller 767, and an annular belt 768 wound around both rollers 766 and 767. The outer peripheral surface of the belt 768 becomes a liquid receiving surface 769 for receiving the liquid. The rollers 766 and 767 are disposed so that the X axis direction is the axial direction and they are separated in the Y axis direction. The belt 768 has a width dimension (a length in the X axis direction) capable of receiving the waste liquid simultaneously ejected by all the nozzles 21 of one liquid droplet ejecting head 1.

The liquid receiving mechanism 751 includes a moisturizing liquid supply portion (not shown) capable of supplying a moisturizing liquid to the liquid receiving surface 769 and a liquid scraping portion (not shown) for scraping off waste liquid or the like adhering to the liquid receiving surface 769 under a moisturized state below the belt 768. When the belt 768 moves due to the rotation of the driving roller 766, the liquid receiving surface 769 scrapes the waste liquid received by the liquid scraping portion from the belt 768. Accordingly, the liquid receiving surface 769 which receives the next liquid droplet is updated to the portion without the waste liquid.

The cap mechanism 752 includes two cap portions 752*a* and a capping motor 755. The two cap portions 752*a* move between the contact position and the retracted position by the power of the capping motor 755. The contact position is a position where the cap portion 752*a* contacts the liquid droplet ejecting heads 1A and 1B, and the retreat position is a position where the cap portion 752*a* separates from the liquid droplet ejecting heads 1A and 1B. When the liquid droplet ejecting heads 1A and 1B stop at the home position HP as indicated by the two-dot chain line in FIG. 15, when the cap portion 752*a* moves from the retreat position to the contact position, the cap portion 752*a* surrounds the opening of the nozzle 21 so as to contact the liquid droplet ejecting heads 1A and 1B. The maintenance in which the cap portion 752*a* surrounds the opening of the nozzle 21 is referred to as capping, and a state where the cap portion 752*a* contacts the liquid droplet ejecting heads 1A and 1B is referred to as a capping state.

One cap portion 752*a* includes four suction caps 770. Each suction cap 770 makes contact with the liquid droplet ejecting head 1 to form a space surrounding the nozzle group (two rows of nozzle rows NL illustrated in FIG. 3). The suction cap 770 is connected to a suction pump 773 via a tube 772. When the suction pump 773 is driven at the time of capping, a negative pressure is generated in the suction cap 770, and the inside of the liquid droplet ejecting head 1 is sucked. By this suction, the thickened liquid and air bubbles in the liquid droplet ejecting head 1 are discharged. Maintenance for discharging liquid from the nozzle 21 by suction is called suction cleaning.

When suction cleaning is performed, the liquid discharged from the nozzle 21 adheres to the liquid droplet ejecting head 1. Therefore, it is preferable to remove adhered liquid droplets or the like by wiping after suction cleaning. In addition, due to wiping, there is a possibility in that foreign matters and air bubbles adhering to the liquid droplet ejecting head 1 may be pushed into the nozzle 21 or the meniscus (gas-liquid interface in the nozzle 21) may be destroyed, and ejecting defects. Therefore, after wiping, it is better to perform flushing, discharge contaminated foreign matter, and arrange meniscus.

Figure 16:
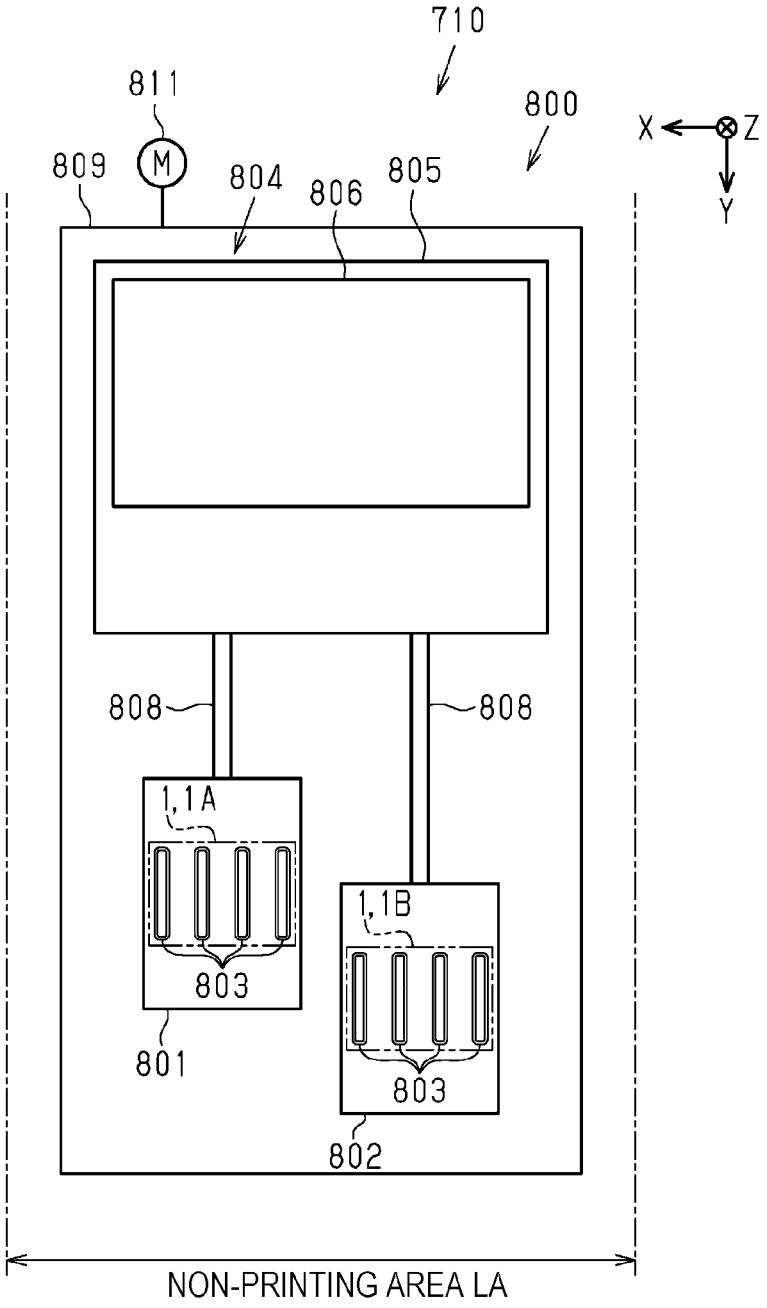
FIG. 16 is a plan view of a cap device of the liquid droplet ejecting apparatus in FIG. 1.

As illustrated in FIG. 16, the cap device 800 includes moisturizing cap portions 801 and 802 and a moisturizing liquid supplying portion 804. When the liquid droplet ejecting heads 1A and 1B stop at the non-printing area LA, the cap portions 801 and 802 contact the liquid droplet ejecting heads 1A and 1B so as to surround the opening of the nozzle 21, respectively. The maintenance in which the cap portions 801 and 802 surround the opening of the nozzle 21 is referred to as moisture retention capping. The moisturizing capping is a kind of capping. Drying of the nozzle 21 is suppressed by moisture retention capping. The cap portions 801 and 802 each have four moisturizing caps 803. The four caps 803 are aligned in the X axis direction corresponding to the four nozzle groups of the liquid droplet ejecting head 1.

Figure 17:
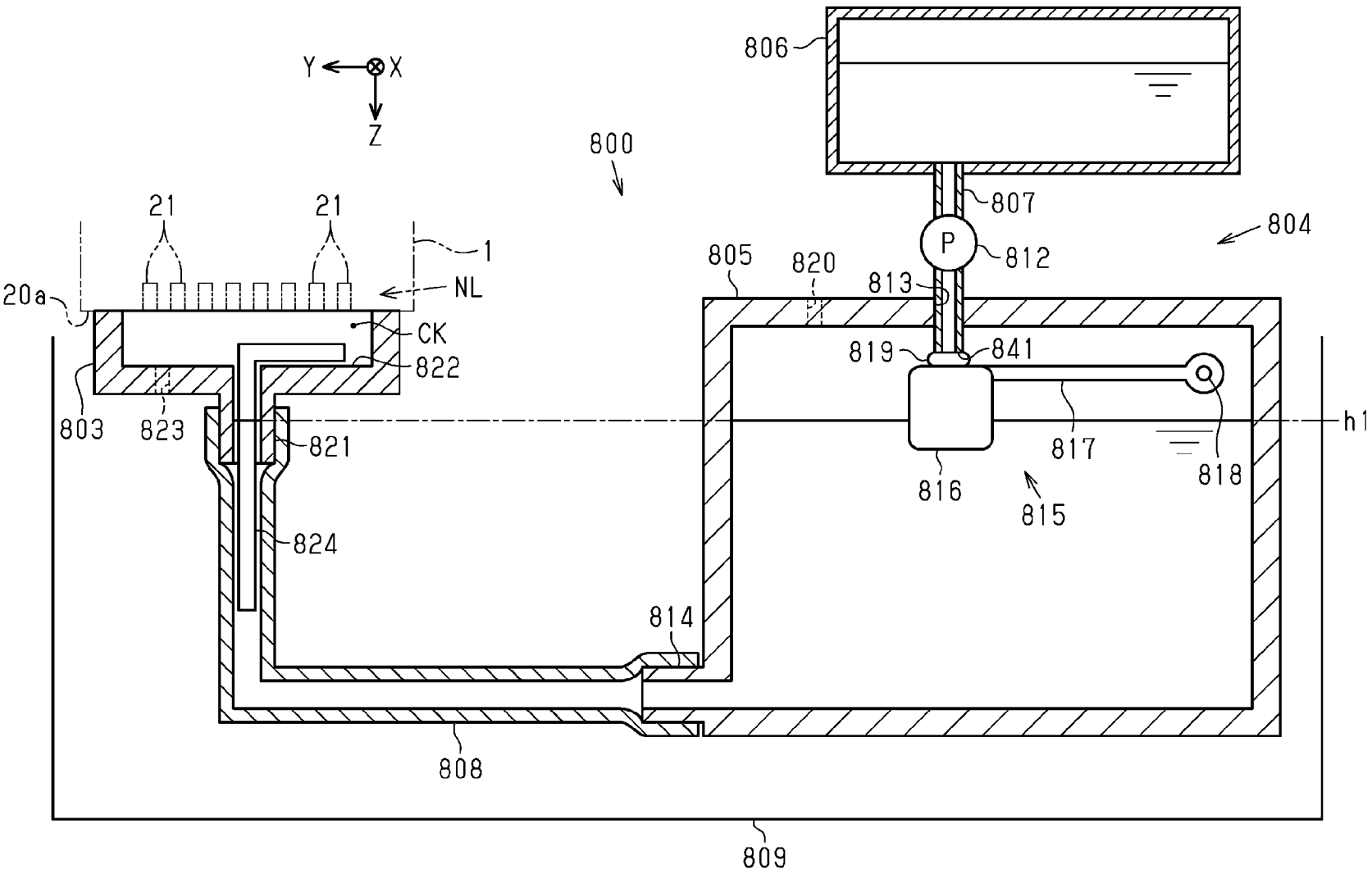
FIG. 17 is a cross-sectional view schematically illustrating a configuration of the cap device in FIG. 16.

As illustrated in FIG. 17, the moisturizing liquid supplying portion 804 includes a moisturizing liquid storage unit 805 for storing the moisturizing liquid, a moisturizing liquid accommodating portion 806 disposed above the moisturizing liquid storage unit 805, and a supply flow path 807 that connects the moisturizing liquid storage unit 805 and the moisturizing liquid accommodating portion 806.

The cap device 800 includes a connection flow path 808 that connects the cap 803 and the moisturizing liquid storage unit 805. In FIG. 16, one connection flow path 808 is illustrated in each of the cap portions 801 and 802. However, actually, four connection flow paths 808 are provided so as to correspond to the number of the cap 803, and a total eight connection flow paths 808 extends from the moisturizing liquid storage unit 805.

The cap device 800 includes a holder 809 that holds the cap portions 801 and 802 and the moisturizing liquid storage unit 805, and a moisturizing motor 811 (see FIG. 16) that vertically moves the holder 809. The cap 803, the moisturizing liquid storage unit 805, and the holder 809 move up and down. By this vertical movement, the cap 803 moves to the contact position where the cap 803 contacts the liquid droplet ejecting head 1 and the retreat position away from the liquid droplet ejecting head 1. That is, the cap 803 can take a capping state in which the cap contacts the liquid droplet ejecting head 1 to form a space CK in which the nozzle 21 is opened, and a non-capping state in which the cap 803 separates from the liquid droplet ejecting head 1.

The supply flow path 807 is a flow path for supplying the moisturizing liquid from the moisturizing liquid accommodating portion 806 to the moisturizing liquid storage unit 805. The upstream end of the supply flow path 807 is connected to the moisturizing liquid accommodating portion 806, and the downstream end thereof is housed in the moisturizing liquid storage unit 805. A hole 813 through which the supply flow path 807 passes is provided in the upper portion of the moisturizing liquid storage unit 805. In the middle of the supply flow path 807, a moisturizing liquid pump 812 for sending the moisturizing liquid in the moisturizing liquid accommodating portion 806 toward the moisturizing liquid storage unit 805 is disposed. The moisturizing liquid pump 812 continues to send the moisturizing liquid with a constant pressure while the power of the liquid droplet ejecting apparatus 700 is turned on.

The moisturizing liquid supplying portion 804 can replace the moisturizing liquid accommodating portion 806 by separately forming the moisturizing liquid storage unit 805, the moisturizing liquid accommodating portion 806, and the supply flow path 807. In this case, by replacing the moisturizing liquid accommodating portion 806, the moisturizing liquid can be replenished.

In the moisturizing liquid supplying portion 804, the moisturizing liquid storage unit 805, the moisturizing liquid accommodating portion 806, and the supply flow path 807 may be integrally formed. In this case, it is advisable to provide a filling port for replenishing the moisturizing liquid to the moisturizing liquid accommodating portion 806.

A float 815 is accommodated in the moisturizing liquid storage unit 805. The float 815 includes a buoyant body 816 floating on the moisturizing liquid, an arm 817 having a buoyant body 816 fixed to the tip end, a shaft 818 for rotatably holding the base end of the arm 817, and an upper part of the buoyant body 816 and a valve portion 819. The buoyant body 816 moves in the moisturizing liquid storage unit 805 so as to draw an arc around the shaft 818 as the liquid level of the moisturizing liquid changes.

When the liquid level of the moisturizing liquid rises in the moisturizing liquid storage unit 805 and reaches a first position h1 indicated by the alternate long and short dashed line in FIG. 17, due to the buoyancy of the buoyant body 816, the valve portion 819 moves to the downstream end 841 of the supply flow path 807. At this time, the valve portion 819 closes the supply flow path 807, and the supply of the moisturizing liquid from the moisturizing liquid accommodating portion 806 is stopped. Further, when the liquid level of the moisturizing liquid falls below the first position h1, the valve portion 819 separates from the downstream end 841 and opens the supply flow path 807. In this manner, the moisturizing liquid supplying portion 804 supplies the moisturizing liquid from the moisturizing liquid accommodating portion 806 so that the level of the moisturizing liquid stored in the moisturizing liquid storage unit 805 is maintained at the first position h1.

A communicating portion 820 for communicating the interior of the moisturizing liquid storage unit 805 with the atmosphere is provided at the upper portion of the moisturizing liquid storage unit 805. The communicating portion 820 forms an elongated hole extending in a serpentine fashion so as to suppress the evaporated moisture in the moisturizing liquid storage unit 805 from being ejected to the outside while maintaining the interior of the moisturizing liquid storage unit 805 in the atmosphere open.

The moisturizing liquid storage unit 805 has a supply port 814 for supplying the stored moisturizing liquid toward the cap 803. The upstream end of the connection flow path 808 is connected to the supply port 814 and the downstream end is connected to the cap 803. The moisturizing liquid stored in the moisturizing liquid storage unit 805 is supplied into the cap 803 via the connection flow path 808 due to a water head difference.

The cap 803 forms a space CK including the nozzle 21 at the moisture retention capping. The cap 803 includes an inner bottom surface 822 of the cap 803 opposed to the nozzle 21 at moisture retention capping, an introduction port 821 opening to an inner bottom surface 822, and an atmosphere communicating portion 823. The downstream end of the connection flow path 808 is connected to the introduction port 821. The atmosphere communicating portion 823 is provided on the inner bottom surface 822 of the cap 803 and opens the space CK formed by moisture retention capping to the atmosphere.

A capillary member 824 having a capillary force is disposed in a downstream portion in the connection flow path 808. The capillary member 824 is a thin string-like member, the proximal end portion of which is disposed in the connection flow path 808, and the distal end portion thereof is disposed along the inner bottom surface 822 of the cap 803. The capillary member 824 may be bent and extended on the inner bottom surface 822 of the cap 803 to the side opposite to the side provided with the atmosphere communicating portion 823. The capillary member 824 is, for example, a sponge-like member having open cells of several μm to several hundred μm. As a material of the capillary member 824, for example, a polyolefin such as EVA or polyethylene is preferable. The capillary member 824 uses the capillary force of the capillary member 824 itself to supply the moisturizing liquid to the cap 803 via the inside of the capillary member 824. In the case where the capillary member 824 has high liquid repellency, capillary force generated in the gap between the surface of the capillary member 824 and the inner surface of the connection flow path 808 is used, and the capillary member 824 passes outside of the capillary member 824 It is also possible to supply the moisturizing liquid toward the cap 803. In this case, air (air bubbles) in the connection flow path 808 is discharged to the cap 803 side via the inside of the capillary member 824. When such a capillary member 824 is disposed in the connection flow path 808, the moisturizing liquid can be easily guided toward the cap 803, so that the moisturizing effect in the space CK is enhanced.

Figure 18:
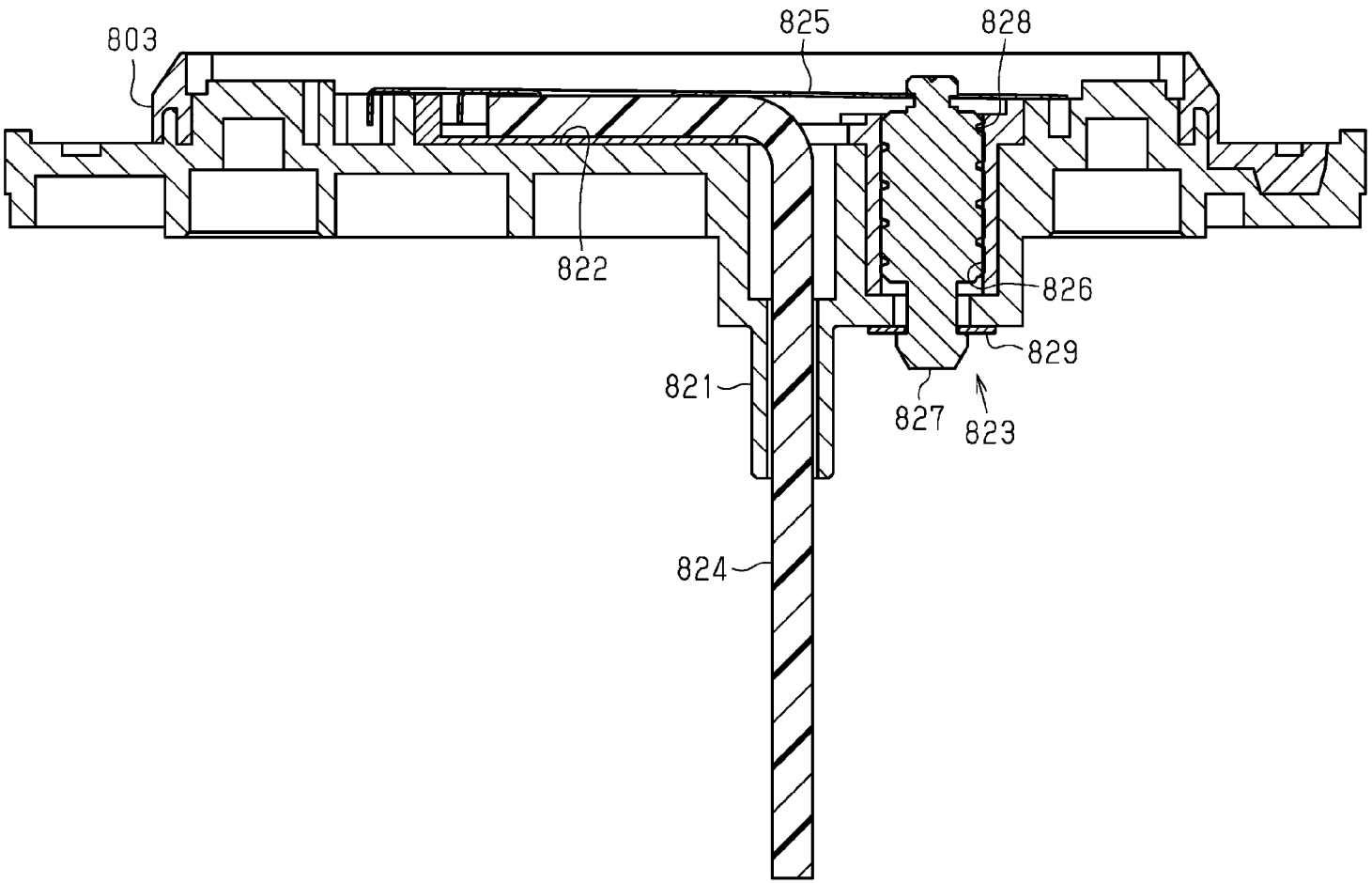
FIG. 18 is a cross-sectional view of a cap of the cap device in FIG. 17.
Figure 19:
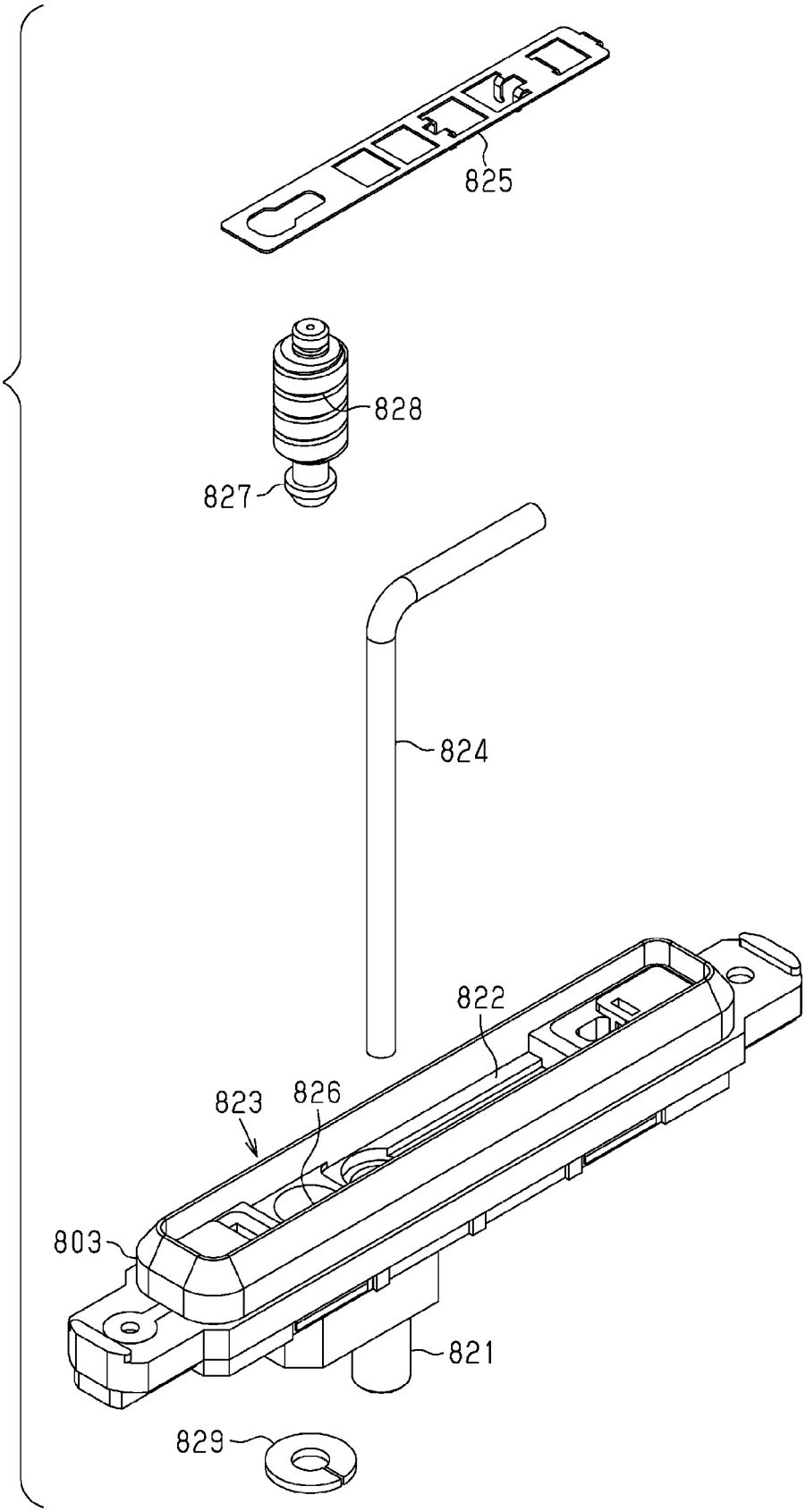
FIG. 19 is an exploded perspective view of the cap in FIG. 18.

As illustrated in FIGS. 18 and 19, it is preferable that a plate member 825 for pressing the capillary member 824 from above is arranged along the inner bottom surface 822 in the cap 803. When the capillary member 824 is pressed by the plate member 825, the capillary member 824 can be made to follow the inner bottom surface 822 of the cap 803.

As illustrated in FIG. 18, the atmosphere communicating portion 823 is preferably configured of a through-hole 826 penetrating the inner bottom surface 822 and a pin 827 press-fitted into the through-hole 826. On the outer periphery of the pin 827, it is preferable to form a narrow groove 828 extending in a spiral shape. When a spiral gap (groove 828) is formed between the inner peripheral surface of the through-hole 826 and the outer peripheral surface of the pin 827, the space CK can be communicated with the atmosphere via this gap. The tip positioned on the inner bottom surface 822 of the pin 827 is preferably pressed by the plate member 825. In addition, the proximal end of the pin 327 may be fastened by a washer 829. In the moisture retention capping, the atmosphere communicating portion 823 releases the space CK of the cap 803 to the atmosphere while suppressing the moisturizing liquid evaporated in the space CK from coming out to the outside.

As illustrated in FIG. 17, the moisturizing liquid stored in the moisturizing liquid storage unit 805 is supplied to the cap 803 due to the water head difference through the connection flow path 808. Therefore, the connection flow path 808 is filled with the moisturizing liquid to the same height as the liquid level of the moisturizing liquid in the moisturizing liquid storage unit 805. That is, the moisturizing liquid flows into the connection flow path 808 to the first position h1. The first position h1 is preferably set so that the lower end portion of the capillary member 824 is immersed in the flowing-in moisturizing liquid within the connection flow path 808.

The first position h1 is preferably set lower than the inner bottom surface 822 of the cap 803. As a result, the space CK is formed at a position higher than the first position h1. The moisturizing liquid that is flown to the first position h1 in the connection flow path 808 evaporates and the evaporated moisturizing liquid fills the space CK of the cap 803, whereby suppressing drying of the nozzle 21. In a case where the liquid level of the moisturizing liquid is lowered by the evaporation, the moisturizing liquid supplying portion 804 supplies the moisturizing liquid, so that the moisturizing effect in the space CK is maintained.

It is preferable that the moisturizing liquid used in the cap device 800 is the same as the main solvent of the liquid used by the liquid droplet ejecting apparatus 700. For example, in a case where the liquid is an aqueous resin ink, since the solvent is water, it is preferable to use pure water as the moisturizing liquid. In a case where the solvent of the ink is a solvent, it is preferable to use the same solvent as the ink as the moisturizing liquid. As a moisturizing liquid, a liquid containing a preservative in pure water may be used.

The preservative to be contained in the moisturizing liquid is preferably the same as the preservative contained in the ink, and examples thereof include aromatic halogen compounds (for example Preventol CMK), methylene dithiocyanate, halogen-containing nitrogen sulfur compounds, 1,2-benzisothiazolin-3-one (for example, PROXELGXL), and the like. In the case where PROXEL is used as a preservative from the viewpoint of poor foamability, it is preferable to set the content in relation to the moisturizing liquid to 0.05% by weight or less.

Regarding Nozzle Inspection in Moisture Retention Capping

The moisture retention capping is performed to suppress drying of the nozzle 21 when not in use, but drying of the nozzle 21 cannot be completely prevented. In addition, in a case where dust or the like adheres to the tip of the cap 803 and does not adhere to the liquid droplet ejecting head 1 at the time of capping, the nozzle 21 becomes easy to dry.

When the moisture retention capping time is lengthened, the solvent of the liquid may evaporate and the ink may thicken or the pigment component may settle. In this manner, ejecting failure may occur in printing after moisture retention capping. Therefore, the control unit 830 performs nozzle inspection at predetermined intervals during moisture retention capping. In the nozzle inspection, when the cap 803 is in the capping state, the detection unit 156 detects the state in the pressure chamber 12. In the nozzle inspection at moisture retention capping, it is preferable to vibrate the pressure chamber 12 to such an extent that the liquid is not ejected from the nozzle 21, and to detect the residual vibration.

While the moisture retention capping is continued, the actuator 130 is driven at regular time intervals, and the detection unit 156 detects the driving waveform of the residual vibration of the pressure chamber 12 each time. Therefore, it possible to respond appropriately according to the degree of progression of thickening.

The control unit 830 may estimate a degree of the progression in thickening of the liquid in the pressure chamber 12 by comparing the drive waveforms of the pressure chambers 12 detected at time intervals in the capping state. The degree of progression of the increment can be calculated as, for example, the thickening of the liquid when a normal moisture retention capping is performed for a certain period of time as a reference value (1.0) and as a ratio to the reference value (thickening ratio illustrated in FIG. 13).

In a case where the detection unit 156 detects that the condition inside the pressure chamber 12 is not normal during moisture retention capping, the control unit 830 may execute the maintenance of the liquid droplet ejecting head 1. In this case, the control unit 830 preferably selects the type of maintenance of the liquid droplet ejecting head 1 according to the degree of increase in thickening of the liquid.

For example, in a case where the result of guessing the progress of thickening exceeds the first standard set as the degree of progression, it is advisable to maintain the liquid droplet ejecting head 1 by discharging the liquid discharging the liquid from the nozzle 21. According to this configuration, by detecting that the state in the pressure chamber 12 is not normal and maintaining the liquid droplet ejecting head 1 before the state deteriorates, it is possible to maintain the liquid droplet ejecting head 1 in a satisfactory state. In addition, the control unit 830 can maintain the liquid droplet ejecting head 1 according to the degree of thickening of the liquid by estimating the degree of progress of thickening.

In a first standard, the nozzle 21 in which the state of the pressure chamber 12 is not normal is present, but the degree is not severe. The liquid discharge may be changed depending on the cause of ejecting defect or the degree of defect. For example, if it is a mild failure, flushing is performed to eject liquid droplets from the nozzle 21 by driving the actuator 130, and suction cleaning is performed if it is medium fault.

In a case where the result of estimating the progress of thickening does not exceed the first standard set as the progression degree, for example, by driving the actuator 130, the pressure chamber 12 may be vibrated to such an extent that the liquid is not ejected from the nozzle 21. The maintenance that slightly vibrates the pressure chamber 12 in this manner is called micro-vibration. In a case where the liquid droplet ejecting head 1 is to be maintained by micro-vibration, the actuator 130 is preferably driven a plurality of times with a single micro-vibration. In a case where a pigment component is settled in the nozzle 21, the precipitated pigment component can be agitated by micro-vibration. If micro-vibration is employed as maintenance, the liquid droplet ejecting head 1 can be maintained without discharging the liquid.

In the case where the result of estimating the progress of thickening exceeds the second standard of increasing the thickening more than the first standard, the control unit 830 preferably determines that the state of the cap 803 is abnormal. An abnormal state exceeding a second standard corresponds to a case where there are many nozzles 21 in which the state of the pressure chamber 12 is abnormal, a case where thickening is progressed in a short time, or the like.

For example, when the supply of the moisturizing liquid to the cap 803 stops due to some factor, the drying of the nozzle 21 may occur suddenly thereafter. In addition, in a case where the liquid contains glycerin as a humectant, when a liquid droplet falls into the cap 803, glycerin contained in the liquid droplet absorbs moisture in the nozzle 21 to promote drying of the nozzle 21.

If such an abnormality occurs in the cap 803, the thickening will excessively proceed, and recovery will be difficult even if normal maintenance is repeated. In such a case, for example, the control unit 830 may notify the user of the abnormality by, for example, displaying the fact that an abnormality has occurred on the operation panel 703. In this manner, the user can grasp that the thickening has proceeded to the second standard, and take appropriate measures such as cleaning the cap 803, replenishing the moisturizing liquid or replacing the cap 803. When occurrence of abnormality is displayed on the operation panel 703, countermeasures corresponding to possible factors or factors (for example, cleaning of the cap 803, confirmation of the remaining amount of the moisturizing liquid, inspection of the cap 803, or the like) may be displayed.

Figure 20:
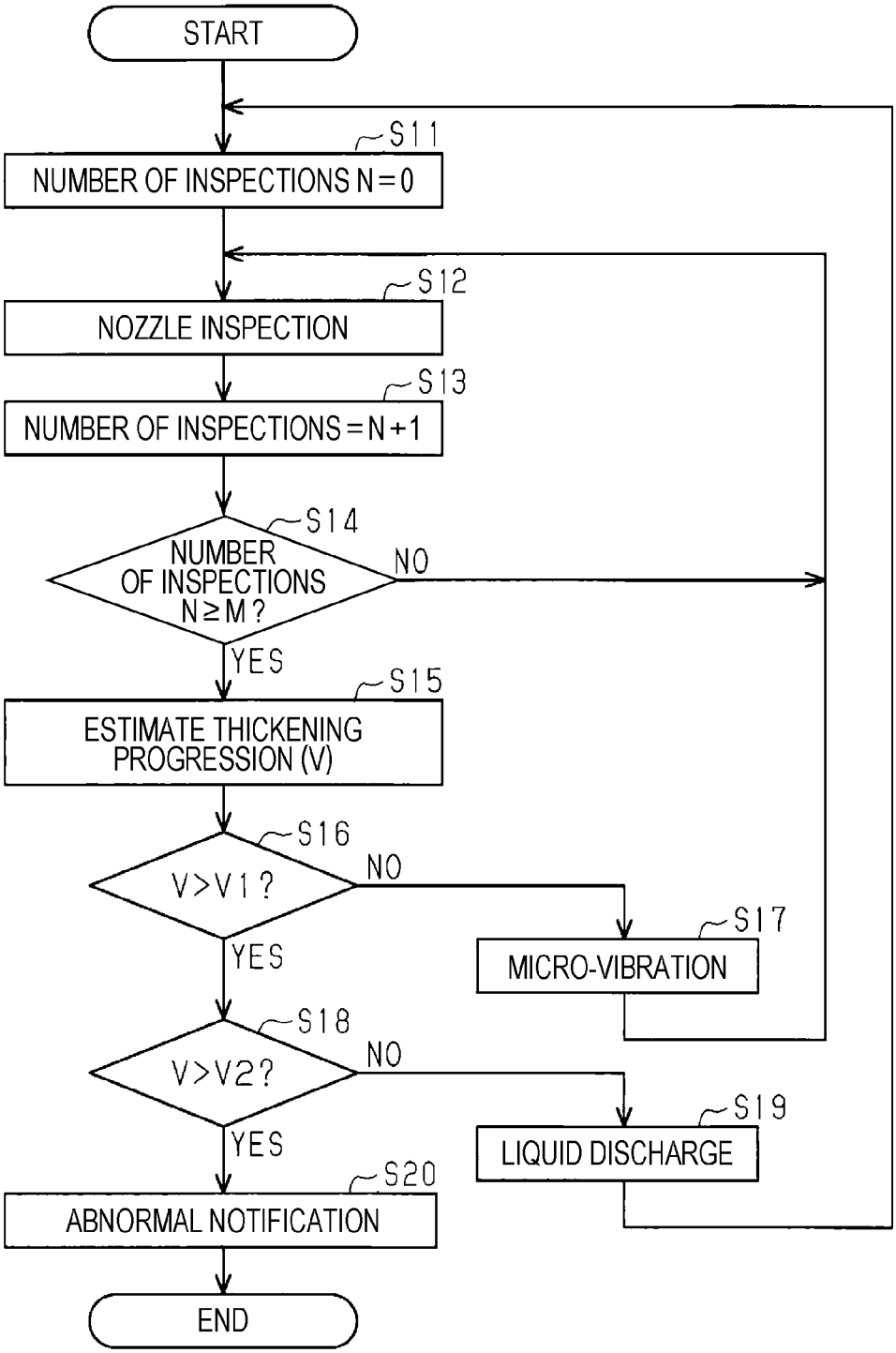
FIG. 20 is a flowchart of control performed by the liquid droplet ejecting apparatus in FIG. 1 in moisture retention capping.

FIG. 20 illustrates an example of processing for nozzle inspection performed by the control unit 830 during moisture retention capping.

As illustrated in FIG. 20, when moisture retention capping is started, the control unit 830 resets the number of nozzle tests in step S11 and then performs nozzle inspection in step S12. In the nozzle inspection, the actuator 130 is driven and the detection unit 156 detects the drive waveform of the residual vibration in the pressure chamber 12.

In step S13, the control unit 830 adds 1 to the inspection numbers N of the nozzle inspection, and in the subsequent step S14, it is determined whether the inspection number N becomes equal to or more than the specified number (M). In a case where the number of inspections N is less than M in step S14, the control unit 830 returns to step S12 and performs the next nozzle inspection. In a case where the number of times of inspection N reaches M or more in step S14, the control unit 830 proceeds to step S15.

The control unit 830 estimates a degree of thickening increase (V) in step S15, and in the subsequent step S16 it is determined whether or not the degree of thickening V exceeds a first standard V1. In step S16, if the degree of thickening increase V does not exceed the first standard V1, the control unit 830 proceeds to step S17. The control unit 830 performs micro-vibration as simple maintenance in step S17 and returns to step S12.

When the degree of thickening increase V exceeds the first standard V1 in step S16, the control unit 830 proceeds to step S18. The control unit 830 determines in step S18 whether the degree of thickening increase V exceeds the second standard V2. In step S18, in a case where the degree of thickening increase V does not exceed the second standard V2, the control unit 830 proceeds to step S19.

The control unit 830 performs maintenance by discharging the liquid (for example, suction cleaning) in step S19, and returns to step S11. Thereafter, the control unit 830 resets the number of inspections in step S11, and proceeds to step S12 to perform the next nozzle inspection.

In a case where the degree of thickening increase V exceeds the second standard V2 in step S18, the control unit 830 determines that the state of the cap 803 is abnormal, and proceeds to step S20. The control unit 830 informs the user that the state of the cap 803 is abnormal in step S20, and ends the process. In a case where abnormality of the cap 803 does not occur, the process is ended as the moisturizing capping ends.

When the micro-vibrations are repeated at moisture retention capping, the gas-liquid interface in the nozzle 21 vibrates, so that the solvent component in the nozzle 21 may evaporate. Evaporation due to vibration of the gas-liquid interface tends to occur particularly when the humidity of the space CK is low. After the detection unit 156 performs the detection, in a case where the micro-vibration is performed until the next detection is performed, so that the thickening of the liquid in the pressure chamber 12 proceeds faster than when the micro-vibration is not performed therebetween, it is preferable that the subsequent micro-vibration is performed by reducing the driving energy of the actuator 130. Therefore, it possible to suppress progress of thickening due to micro-vibration.

For example, the control unit 830 executes M nozzle tests at regular intervals (M is a positive integer) without micro-vibration at the intervals after the moisture retention capping is started, as a negative control, thickening the degree (Vn) of progression of thickening therebetween is stored. Thereafter, the control unit 830 performs M nozzle inspections at regular intervals as a positive control while micro-vibration the interval, and stores the degree of progress of thickening (Vy) during that interval. If Vy of the positive control is significantly more progression of thickening than Vn of the negative control, it is suspected that evaporation of the solvent us accelerated by micro-vibration. Therefore, in this case, in order to reduce the adverse influence of micro-vibration, the driving energy of the actuator 130 at the time of micro-vibration thereafter is reduced.

As a variation of decreasing the driving energy of the actuator 130 when performing micro-vibration, for example, the amplitude of vibration may be reduced, the number of times of driving with one micro-vibration may be reduced, the time interval at which the micro-vibration is performed may be lengthened.

In the case where the adverse effect of the micro-vibration is large or when the thickening increases even if the driving energy of the actuator 130 is made small, the subsequent micro-vibration may not be performed. Therefore, it possible to prevent progress of thickening due to micro-vibration. Also in this case, the inside of the nozzle 21 is agitated by vibrating the pressure chamber 12 for nozzle inspection.

Next, operations and effects of the liquid droplet ejecting apparatus 700 configured as described above will be described.

In the liquid droplet ejecting apparatus 700, since the nozzle inspection is performed at moisture retention capping, even when the moisture retention capping has been performed for a long time, an abnormality occurring in the pressure chamber 12 is detected and the liquid droplet ejecting head 1 can be properly maintained. In addition, even in a case where some sort of abnormality occurs in the cap device 800 and the thickening progresses to such an extent that it cannot be recovered by maintenance, it can be detected and notified to the user. Therefore, it is avoided to consume liquid by wasteful maintenance.

As described above, according to the above embodiment, it is possible to take measures to stabilize the ejecting of liquid droplets from the nozzle 21 based on the state in the pressure chamber 12. As a result, ejecting failures after capping can be suppressed, and a state in which liquid droplets can be ejected satisfactorily can be maintained.

Modification Example of Cap Device

Figure 21:
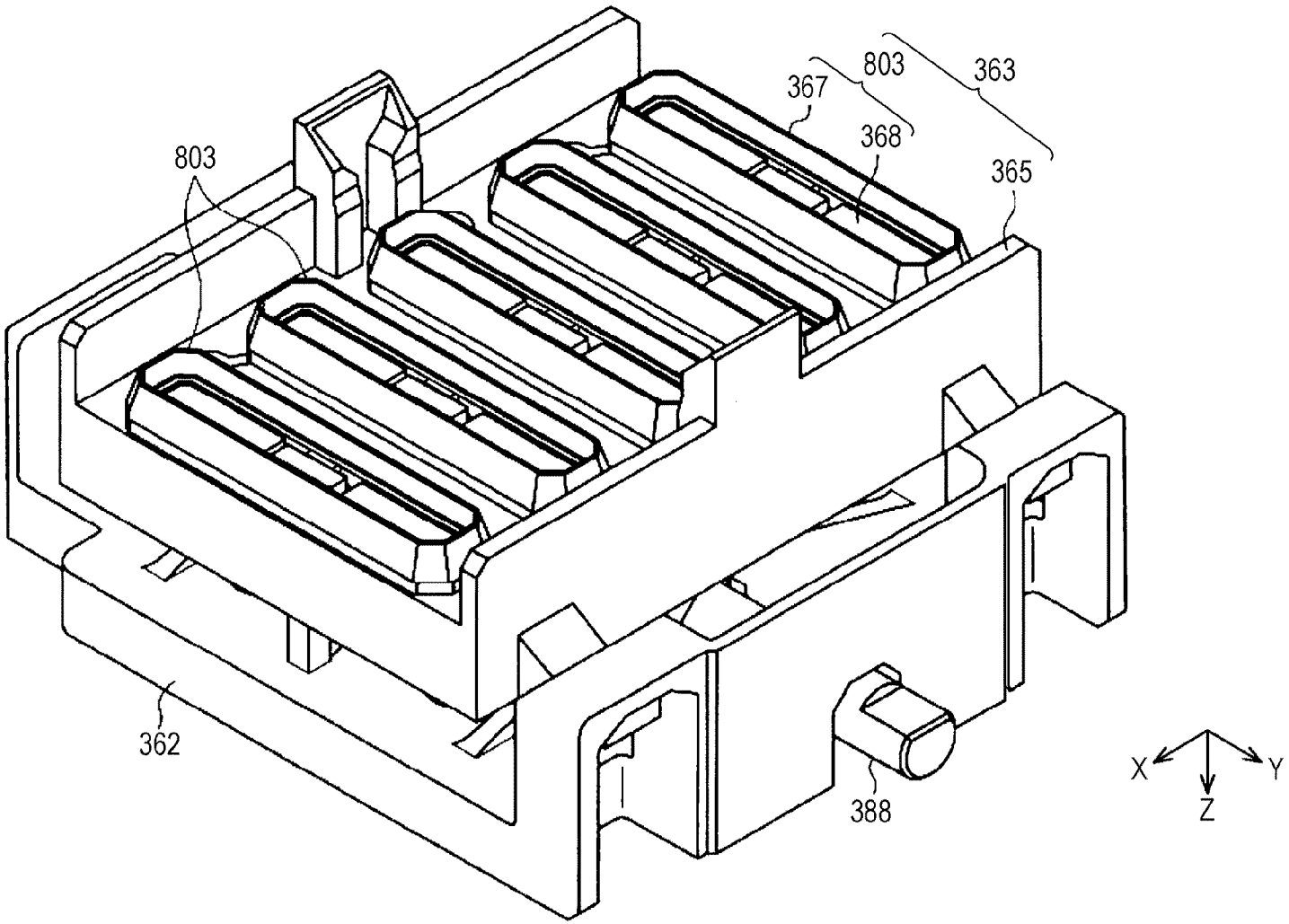
FIG. 21 is a perspective view illustrating a modification example of the cap device.

The cap device 800 of the liquid droplet ejecting apparatus 700 can be changed to a cap device 361 illustrated in FIG. 21.

As illustrated in FIG. 21, the cap device 361 includes a cap holder 362 and a cap body 363 held by the cap holder 362. The cap body 363 includes a moisturizing cap 803 and a support portion 365 that supports at least one cap 803.

The cap holder 362 holds a plurality of caps 803. The cap 803 includes an annular frame portion 367 formed of an elastic member such as elastomer and a rigid member 368 fitted to the frame portion 367.

The rigid member 368 is preferably formed of a hard synthetic resin having high gas barrier properties such as polypropylene (PP). As the material of the rigid member 368, any material can be adopted as long as it is a hard material having high gas barrier properties, and examples thereof include polyethylene (PE), polyethylene terephthalate (PET), modified polyphenylene ether (modified PPE) or the like may be adopted.

Figure 22:
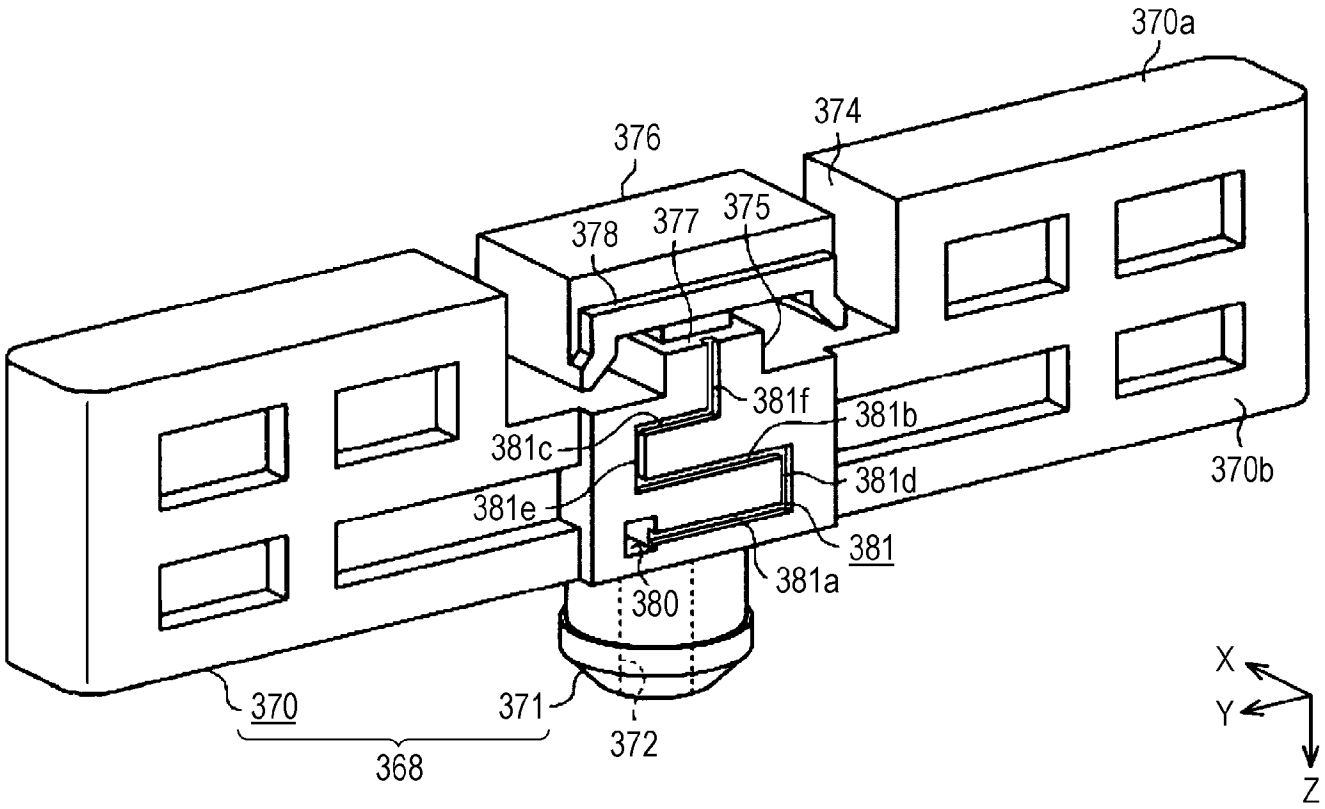
FIG. 22 is a perspective view of a rigid member of the cap device in FIG. 21.

As illustrated in FIG. 22, the rigid member 368 includes a main body portion 370 having a rectangular parallelepiped outer shape, and a circular tubular protruding portion 371 protruding from the main body portion 370. The main body portion 370 has a first side surface 370*b* and a second side surface 370*c* which are side faces extending in the Y axis direction and the Z axis direction which are the longitudinal direction. The protruding portion 371 has a hollow portion 372 therein.

The surface of the main body portion 370 on which the protruding portion 371 is formed is defined as the lower surface, and the surface opposite to the lower surface is defined as the upper surface 370*a*. The upper surface 370*a* becomes the inner bottom surface of the cap 803 when the rigid member 368 is fitted to the frame portion 367.

A concave portion 374 is formed in the center position in the longitudinal direction on the upper surface 370*a* of the main body portion 370. On the inner bottom surface of the concave portion 374, a ridge 375 extending in the lateral direction and a cap portion 376 having a substantially rectangular plate shape in a plan view are integrally formed with the main body portion 370. An annular concave portion 377 is formed at the boundary between the ridge 375 and the cap portion 376.

On both side surfaces of the cap portion 376, stepped portions 378 are respectively formed. Both ends in the longitudinal direction of each stepped portion 378 is inclined so as to be bent at right angles downward and then diagonally downward.

The main body portion 370 includes a through-hole 380 penetrating therethrough in a lateral direction from the first side surface 370*b*. Furthermore, a first groove portion 381 joining with meandering through-hole 380 and annular recess 377 is formed on the first side surface 370*b*.

The first groove portion 381 is configured of a first longitudinal groove portion 381*a*, a second longitudinal groove portion 381*b*, and a third longitudinal groove portion 381*c* extending in the Y axis direction, a first vertical groove portion 381*d* extending in the Z axis direction, a second vertical groove portion 381*e*, and a third vertical groove portion 381*f*. The first longitudinal groove portion 381*a*, the second longitudinal groove portion 381*b*, and the third longitudinal groove portion 381*c* are formed at different positions in the Z axis direction. The first vertical groove portion 381*d*, the second vertical groove portion 381*e*, and the third vertical groove portion 381*f* are formed at different positions in the Y axis direction and the Z axis direction.

The first longitudinal groove portion 381*a* connects the through-hole 380 and the lower end of the first vertical groove portion 381*d*. The second longitudinal groove portion 381*b* connects the upper end of the first vertical groove portion 381*d* and the lower end of the second vertical groove portion 381*e*. The third longitudinal groove portion 381*c* connects the upper end of the second vertical groove portion 381*e* and the lower end of the third vertical groove portion 381*f*. The upper end of the third vertical groove portion 381*f* is opposed to the lower surface of the cap portion 376.

Figure 23:
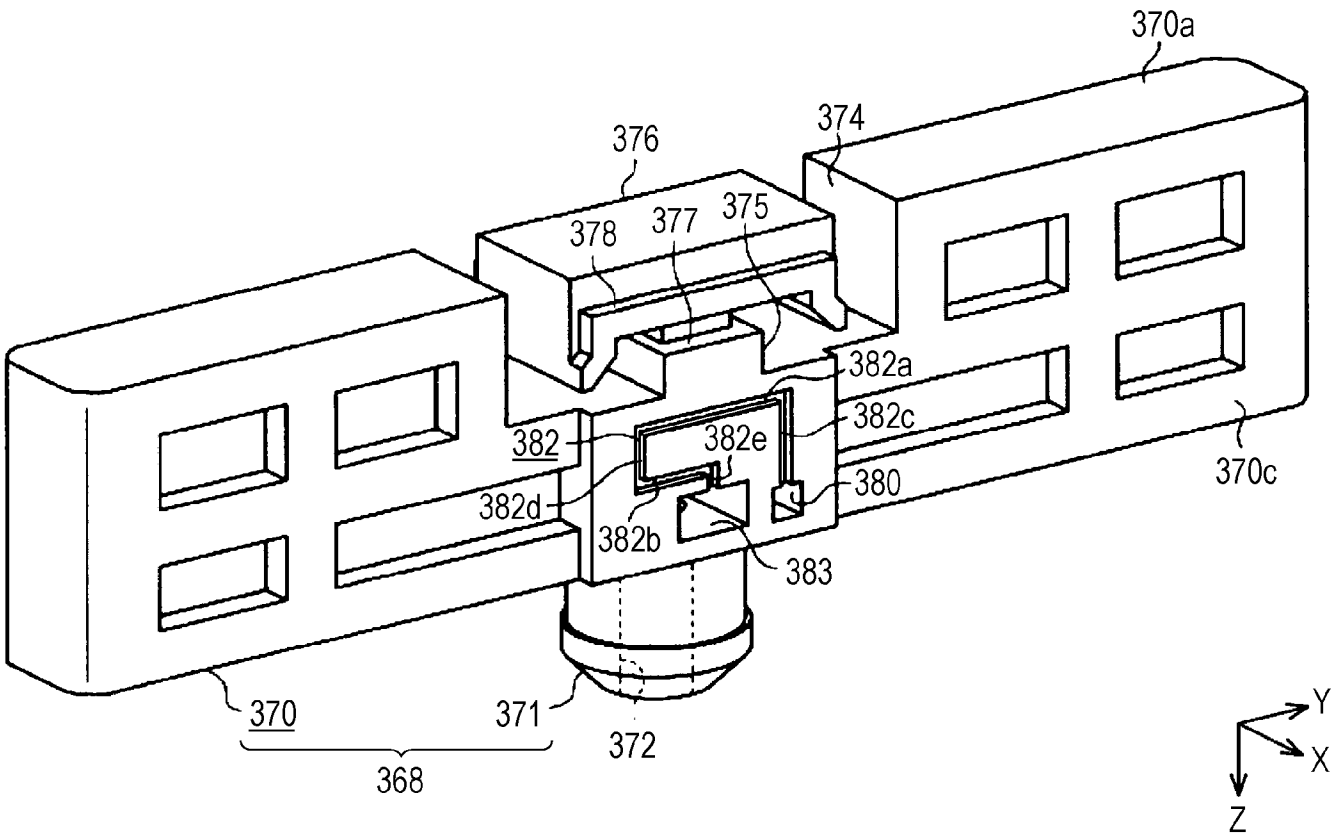
FIG. 23 is a perspective view of the rigid member of FIG. 22 as seen from an opposite side.

As illustrated in FIG. 23, a second groove portion 382 includes one end connected to the through-hole 380 and a connection hole 383 connecting the other end of the second groove portion 382 and the hollow portion 372 are formed in the second side surface 370*c*. The second groove portion 382 meanders so as to connect the through-hole 380 and the connection hole 383.

The second groove portion 382 is configured of a fourth longitudinal groove portion 382*a* and a fifth longitudinal groove portion 382*b* extending in the Y axis direction, a fourth vertical groove portion 382*c* extending in the Z axis direction, a fifth vertical groove portion 382*d*, and a sixth vertical groove portion 382*e*. The fourth longitudinal groove portion 382*a* and the fifth longitudinal groove portion 382*b* are formed at different positions in the Z axis direction. The fourth vertical groove portion 382*c*, the fifth vertical groove portion 382*d*, and the sixth vertical groove portion 382*e* are formed at different positions in the Y axis direction.

The lower end of the fourth vertical groove portion 382*c* is connected to the through-hole 380. The fourth longitudinal groove portion 382*a* connects the upper end of the fourth vertical groove portion 382*c* and the upper end of the fifth vertical groove portion 382*d*. The fifth longitudinal groove portion 382*b* connects the lower end of the fifth vertical groove portion 382*d* and the upper end of the sixth upper and lower groove portion 382*e*. The lower end of the sixth vertical groove portion 382*e* is connected to the connection hole 383.

Figure 24:
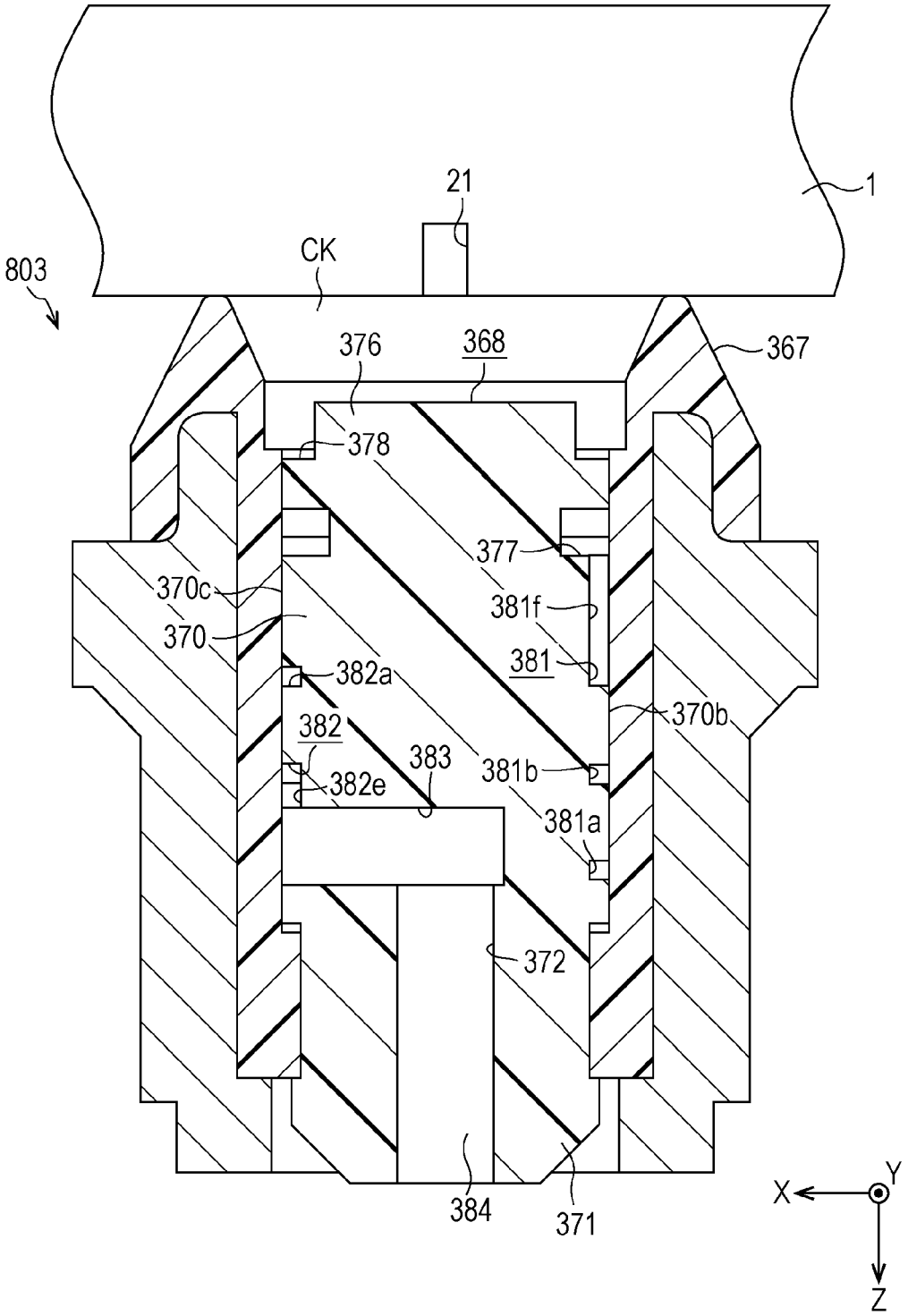
FIG. 24 is a cross-sectional view of the cap device in FIG. 21.

As illustrated in FIG. 24, when the rigid member 368 is attached to the frame portion 367, the first side surface 370*b* and the second side surface 370*c* of the rigid member 368 are brought into close contact with the inner surface of the frame portion 367. Accordingly, the openings of the first groove portion 381, the second groove portion 382, the through-hole 380, and the connection hole 383 are covered with the inner surface of the frame portion 367, and each of the openings serves as a ventilation path. In addition, the gap between the main body portion 370 and the cap portion 376 also becomes a ventilation path. These ventilation paths and the hollow portion 372 constitute an atmosphere communicating portion 384 which communicates the space CK in which the nozzle 21 opens with the atmosphere.

When the cap 803 contacts the liquid droplet ejecting head 1, a space CK in which the nozzle 21 opens is formed. The cap body 363 is a consumable item of which function of sealing the space CK is deteriorated in a state where the space CK in which the nozzle 21 opens is communicated with the atmosphere, for example, when the liquid adheres to the atmosphere communicating portion 384 and dries, or the like.

Figure 25:
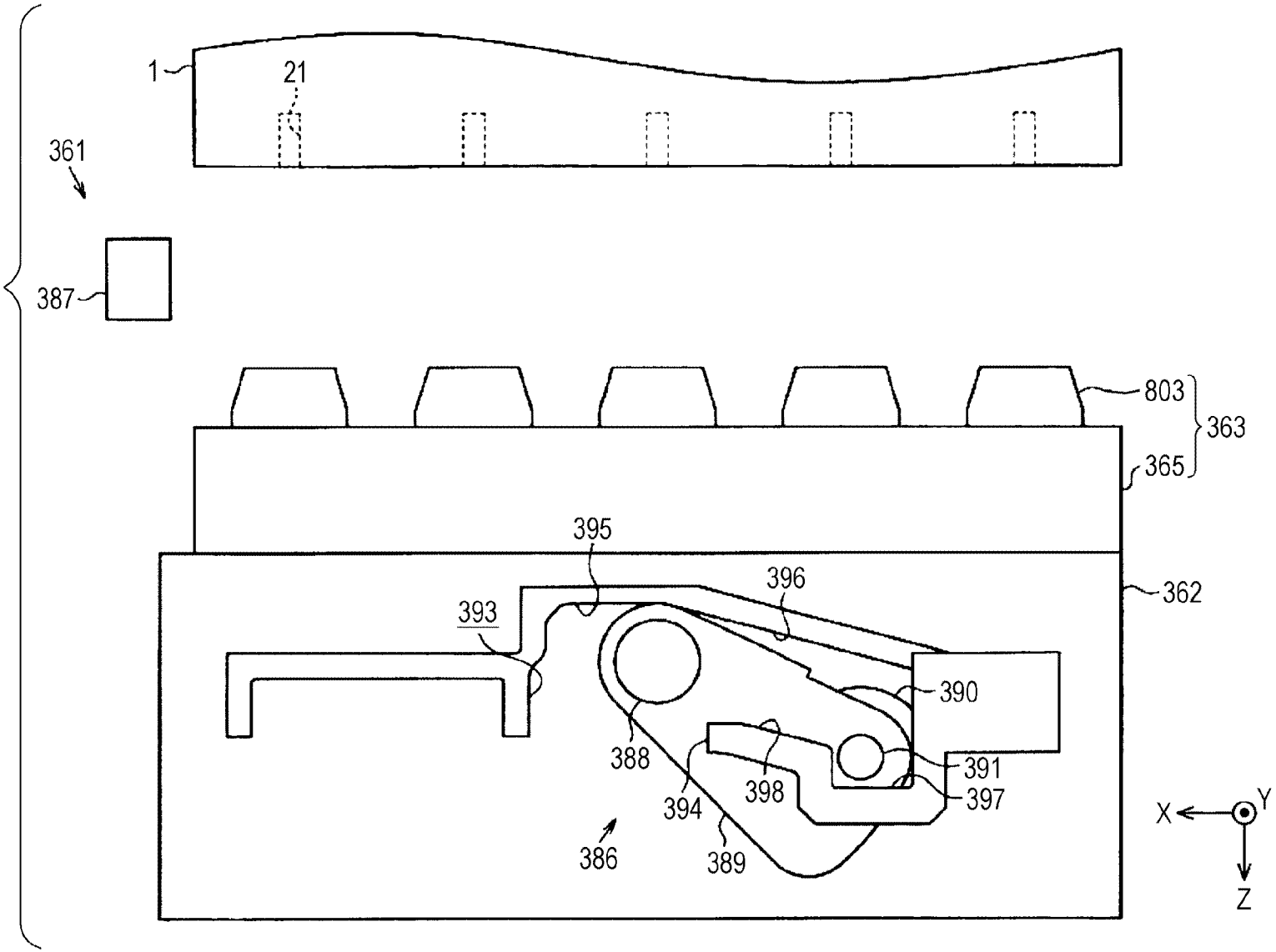
FIG. 25 is a front view of a cam mechanism of the cap device in FIG. 21.

As illustrated in FIG. 25, the cap device 361 includes the cam mechanism 386 that raises and lowers the cap holder 362. The cap body 363 and the cap holder 362 move up and down integrally by the operation of the cam mechanism 386. The cap device 361 includes a restricting portion 387 that contacts the raised cap holder 362 and restricts movement.

The cam mechanism 386 includes a rotating shaft 388 which is rotated by rotation driving of a motor (not shown), and a substantially triangular cam frame 389 whose base end portion is fixed to the rotating shaft 388. A shaft portion 391 of a cam roller 390 is rotatably supported at a distal end portion of the cam frame 389. The shaft portion 391 of the cam roller 390 passes through the cam frame 389 and protrudes from both side surfaces of the cam frame 389. When the cam frame 389 rotates around the rotating shaft 388 as the rotating shaft 388 rotates, the cam roller 390 supported at the distal end portion of the cam frame 389 circulates around the rotating shaft 388.

A cam groove 393 is formed in the cap holder 362 at a position corresponding to the cam mechanism 386. The cam groove 393 has an opening 394 that opens downward, and the cam mechanism 386 is inserted from the opening 394, whereby supporting the cap holder 362 by the cam mechanism 386.

The cam groove 393 includes a flat portion 395 positioned above the opening 394 and a first inclined surface portion 396 extending obliquely downward from the flat portion 395. The cam groove 393 includes a concave surface portion 397 and a second inclined surface portion 398 extending obliquely downward from the concave surface portion 397 at positions that can come into contact with both ends of the shaft portion 391. The first inclined surface portion 396 and the second inclined surface portion 398 are substantially parallel.

Next, a process of detecting malfunction of the cap body 363 will be described. The function failure detection process of the cap body 363 is executed periodically or based on an instruction from the user.

First, the control unit 830 (see FIG. 11) detects the vibration waveform of the pressure chamber 12 before performing capping by the cap 803 by using the detection unit 156 after executing suction cleaning. Next, the control unit 830 moves the cap 803 upward so as to contact the liquid droplet ejecting head 1.

Subsequently, the control unit 830 descends the cap 803 to release the capping. Thereafter, the control unit 830 uses the detection unit 156 to detect the vibration waveform of the pressure chamber 12 after capping. Subsequently, the control unit 830 compares vibration waveforms before and after capping, and determines whether air bubbles are mixed in the nozzle 21 and the pressure chamber 12. In a case where the number of air bubbles in the nozzle 21 and the pressure chamber 12 are not increased, the control unit 830 ends the malfunction detection process of the cap 803.

On the other hand, in a case where the number of pressure chambers 12 in which air bubbles have been mixed in the inspection after capping is increased as compared with the number of pressure chambers 12 in which air bubbles are mixed in the inspection before capping, the control unit 830 determines that the atmosphere communicating portion 384 is malfunctioning, and informs the user that replacement of the cap 803 is necessary, and ends the malfunction detecting process of the cap 803. For example, notification to the user can be performed by displaying information on the operation panel 703.

Next, a method of determining whether replacement of the liquid droplet ejecting head 1 is necessary will be described with reference to the flowchart of FIG. 26. The control unit 830 of the liquid droplet ejecting apparatus 700 according to the present embodiment determines whether the maintenance unit 710 is functioning properly and then determines whether or not to replace the liquid droplet ejecting head 1.

Figure 26:
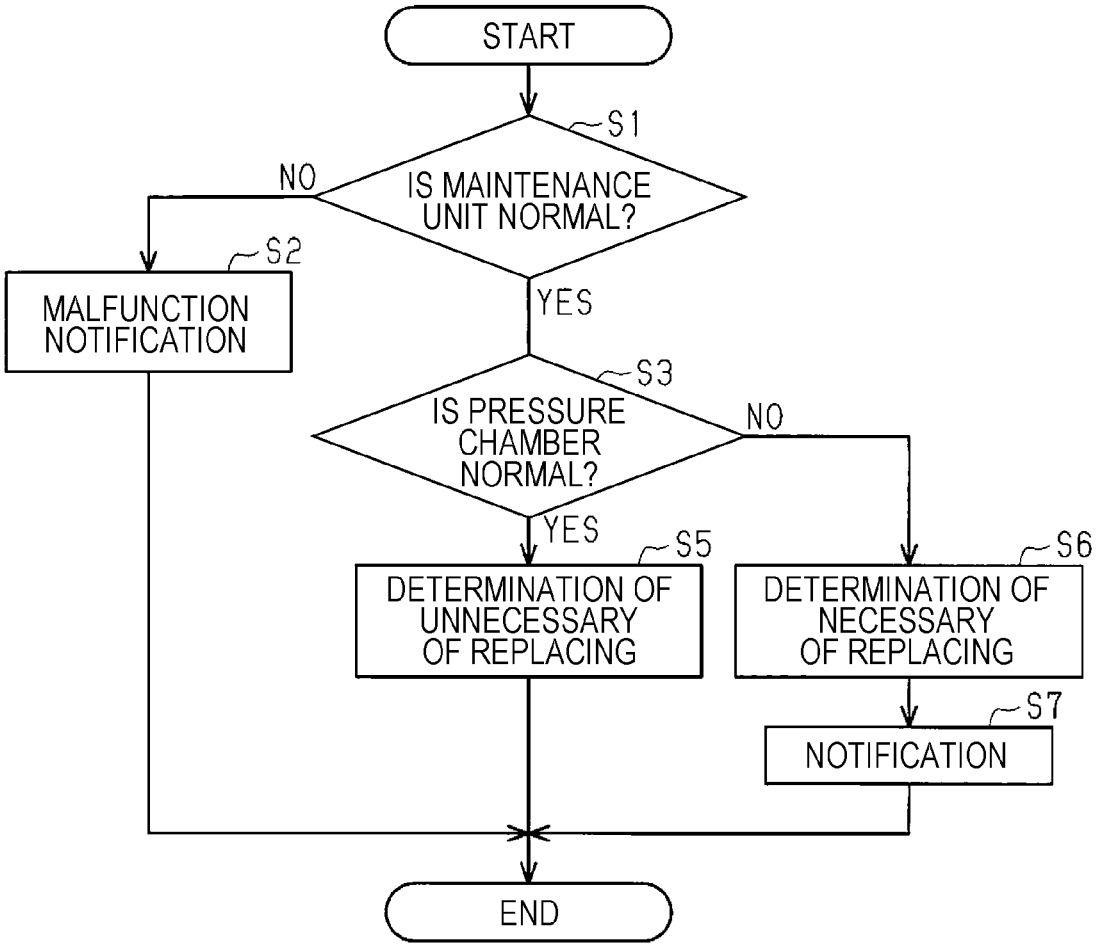
FIG. 26 is a flowchart for illustrating a method of determining necessity of replacement of the liquid droplet ejecting head.

As illustrated in FIG. 26, in step S1, the control unit 830 determines whether the air bubbles in the pressure chamber 12 is increased due to maintenance (maintenance unit normality determination process). At this time, the control unit 830 compares the vibration waveform of the pressure chamber 12 detected by the detection unit 156 before the maintenance with the vibration waveform of the pressure chamber 12 detected during at least one of the maintenance and after the maintenance, and air bubbles are increased as a result of the determination. In step S1, the control unit 830 can adopt the already described function detection processing of the cap 803 and the like.

When the control unit 830 determines that air bubbles have increased in step S1, the control unit 830 proceeds to step S2. In step S2, the control unit 830 determines that the maintenance unit 710 is malfunctioning and informs the user to that the message (function failure notification process). After step S2, the control unit 830 ends the control.

If the control unit 830 determines in step S1 that no air bubbles have increased, the control unit 830 proceeds to step S3. In step S3, the control unit 830 determines whether the detection unit 156 detects that the state in the pressure chamber 12 is not normal for a predetermined number of times (pressure chamber abnormality determination process).

If it is determined in step S3 that the state in the pressure chamber 12 is normal (or that less than a predetermined number of times that it is not normal has been detected), the control unit 830 proceeds to step S5. In step S5, the control unit 830 determines that replacement of the liquid droplet ejecting head 1 is unnecessary (replacement unnecessary determination process), and ends the control.

In a case where it is determined that the control unit 830 determines in step S3 that the state in the pressure chamber 12 is not normal for a predetermined number of times, the control unit 830 proceeds to step S6. In step S6, the control unit 830 determines that it is necessary to replace the liquid droplet ejecting head 1 (replacement necessity determination process). After step S6, the control unit 830 notifies the user that the replacement of the liquid droplet ejecting head 1 is necessary on the operation panel 703 (step S7) (replacement information display process). After step S7, the control unit 830 ends the control.

Figure 27:
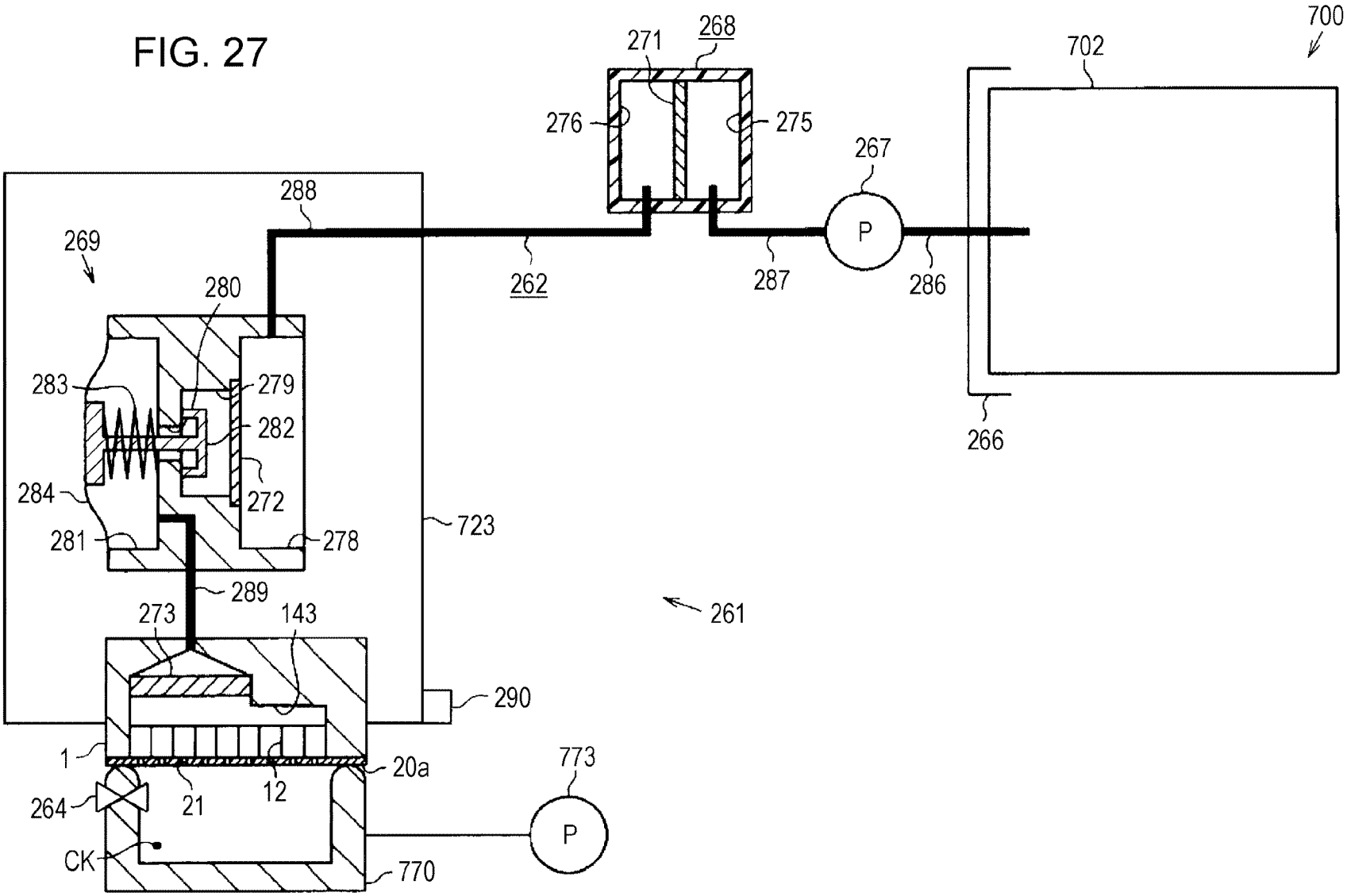
FIG. 27 is an overall configuration diagram schematically illustrating a modification example of the liquid droplet ejecting apparatus.

As illustrated in FIG. 27, the RGB camera 290 may be attached to the carriage 723. The RGB camera 290 reads a color image formed by ejecting liquid droplets on the medium ST by RGB color separation, thereby detecting whether the liquid droplet is actually ejected from the nozzle 21. In this case, in a case where the image quality of the color image detected by the RGB camera 290 exceeds a predetermined allowable amount (for example, when the landing position of the ink is not within a predetermined area), the control unit 830 determines that the ejecting state of the ink is not normal.

The detection and determination of the ejecting state of the liquid droplet by the RGB camera 290 can be performed as step S4 after step S3, for example. In a case where the ejecting state of the ink is not normal, the process proceeds to step S6, and it is determined that replacement is necessary. In a case where the ejecting state of ink is normal, the process proceeds to step S5 and it is determined that replacement is unnecessary.

Modification Example of Liquid Droplet Ejecting Apparatus

FIG. 27 illustrates a modified example of the liquid droplet ejecting apparatus 700.

As illustrated in FIG. 27, the liquid droplet ejecting apparatus 700 according to a modified example includes the liquid droplet ejecting head 1 and at least one supply mechanism 261. The supply mechanism 261 is configured to be able to supply the liquid contained in the liquid supply source 702 to the liquid droplet ejecting head 1. The liquid supply source 702 is not mounted on the carriage 723. The liquid supply source 702 is disposed at a position away from the carriage 723. To the carriage 723, an RGB camera 290 for detecting the ejecting state of liquid droplets may be attached.

The liquid supply source 702 is an accommodating container capable of accommodating a liquid, and is detachably attached to a mounting portion 266. The liquid supply source may be an accommodating tank fixed to the mounting portion 266 instead of the liquid supply source 702. The accommodating tank may be provided with a fillable inlet for liquid. The mounting portion 266 can hold a plurality of liquid supply sources 702.

The liquid droplet ejecting apparatus 700 includes the suction cap 770 and the suction pump 773. The suction cap 770 forms a space CK in contact with the liquid droplet ejecting head 1 to open the nozzle 21. The suction cap 770 is provided with an atmosphere release valve 264. The atmosphere release valve 264 communicates the space CK with the atmosphere at the time of valve opening and makes the space CK not to communicate with the atmosphere at the time of valve closing. When the suction pump 773 is driven with the atmosphere release valve 264 closed during capping by the suction cap 770, the inside of the nozzle 21 is sucked by the negative pressure generated in the space CK. As described above, at the time of suction cleaning, the atmosphere release valve 264 is closed. In addition, when the suction cap 770 moves away from the liquid droplet ejecting head 1, the atmosphere release valve 264 opens.

The supply mechanism 261 is provided with a liquid supply path 262 for supplying liquid to the nozzle 21 on the downstream side from the liquid supply source 702 on the upstream side. A supply pump 267 for causing the liquid to flow from the liquid supply source 702 toward the nozzle 21, a filter unit 268, and a pressure regulating valve 269 for adjusting the pressure of the liquid are arranged in the liquid supply path 262. The supply pump 267 is, for example, a gear pump or a vibrating plate pump.

The filter unit 268 includes a first filter 271, and is partitioned into an upstream chamber 275 and a downstream chamber 276 by a first filter 271. The filter unit 268 is detachably provided to the liquid supply path 262.

The pressure regulating valve 269 includes a second filter 272, and the liquid droplet ejecting head 1 includes a third filter 273. The second filter 272 and the third filter 273 are detachably provided to the liquid supply path 262. The first filter 271, the second filter 272, and the third filter 273 are expendable items whose filtration function is deteriorated as foreign matters in the passing liquid are collected.

The pressure regulating valve 269 includes a filter chamber 278 partitioned by the second filter 272 and a supply chamber 279. The pressure regulating valve 269 includes a pressure regulating chamber 281 communicating with the supply chamber 279 via a communication hole 280, a valve body 282 capable of opening and closing between the pressure regulating chamber 281 and a supply chamber 279, a valve body 282 biasing the valve body 282 and a biasing member 283. The valve body 282 closes the communication hole 280 by the urging force of the biasing member 283.

The pressure regulating chamber 281 is configured of a diaphragm 284 in which a part of the wall surface can be flexibly deformed. The diaphragm 284 receives the atmospheric pressure on the outer surface side and receives the pressure of the liquid in the pressure regulating chamber 281 and the biasing force of the biasing member 283 on the inner surface side. The diaphragm 284 flexibly displaces according to the change in the differential pressure between the pressure inside the pressure regulating chamber 281 and the pressure received on the outer surface side, and as the diaphragm 284 is displaced toward the inside of the pressure regulating chamber 281, the valve body 282 opens the communication hole 280.

The liquid supply path 262 includes a first connection flow path 286, a second connection flow path 287, a third connection flow path 288, and a fourth connection flow path 289. The first connection flow path 286 connects the liquid supply source 702 and the supply pump 267. The second connection flow path 287 connects the supply pump 267 and the upstream chamber 275 of the filter unit 268. The third connection flow path 288 connects the downstream chamber 276 of the filter unit 268 and the filter chamber 278 of the pressure regulating valve 269. The fourth connection flow path 289 connects the pressure regulating chamber 281 of the pressure regulating valve 269 and a reservoir 143 which is a common liquid chamber of the liquid droplet ejecting head 1.

The control unit 830 (see FIG. 11) counts the number of times the liquid droplet is ejected from the nozzle 21 and the number of times the liquid droplet ejecting head 1 subjected to maintenance. The control unit 830 calculates the amount of liquid consumed by the liquid droplet ejecting head 1 based on the number of times of maintenance and stores the calculated amount in the memory 153 (see FIG. 11) as the liquid path amount in the liquid supply path 262. In this manner, the memory 153 stores the passing amount which is the amount of liquid that has passed through the filters 271 to 273.

Next, the operation in a case where the clogging of the filters 271 to 273 is detected will be described. In the liquid droplet ejecting apparatus 700, when suction cleaning is executed, foreign matter such as the liquid and air bubbles are discharged from the nozzle 21 covered with the suction cap 770. Therefore, when the detection unit 156 performs the nozzle inspection after the suction cleaning, it is possible to reduce the possibility that the nozzle 21 and the pressure chamber 12 in which bubbles are mixed are detected.

When flushing is performed after nozzle inspection, liquid is supplied from the liquid supply source 702 toward the nozzle 21 through the liquid supply path 262. The filters 271 to 273 are provided in the liquid supply path 262, and the liquid passes through the filters 271 to 273 and is supplied to the nozzle 21. Therefore, when the filters 271 to 273 are clogged, it becomes difficult for the liquid to flow, and the amount of liquid that can be ejected by the nozzle 21 per unit time passes through the filters 271 to 273 per unit time and flows through the nozzles 21. The amount of liquid that can be supplied may be smaller.

In other words, in a case where the filters 271 to 273 are clogged, there is a case that a sufficient amount of liquid is not supplied even if liquid droplets are ejected from the nozzles 21. Therefore, the negative pressure in the liquid supply path 262 between the nozzle 21 and the filters 271 to 273 is increased, and air (bubbles) is easily drawn from the nozzle 21.

By performing the nozzle inspection by the detection unit 156, it is possible to detect the nozzle 21 and the pressure chamber 12 in which air bubbles are drawn. That is, the control unit 830 detects the vibration waveform of the pressure chamber 12 before and after the flushing, and determines whether the filters 271 to 273 are clogged based on the change in the state of the pressure chamber 12 due to flushing.

The control unit 830 determines that the filters 271 to 273 are clogged when the change in the state in the pressure chamber 12 detected before and after flushing is an increase in bubbles in the pressure chamber 12. Specifically, in a case where there are a large number of pressure chambers 12 in which bubbles detected by nozzle inspection are mixed after flushing before flushing, it is estimated that bubbles are mixed in accompanied with flushing. In this case, it is considered that the supply mechanism 261 is in a state in which the filters 271 to 273 are clogged and it is impossible to supply a sufficient amount of liquid. Therefore, in a case where the control unit 830 determines that the filters 271 to 273 are clogged and malfunctioning, the control unit 830 urges the user to replace the filters 271 to 273.

On the other hand, in a case where it is determined that the functions of the filters 271 to 273 are normal, the control unit 830 can determine whether the detection unit 156 detects that the state in the pressure chamber 12 is not normal by a predetermined number of times. Then, the control unit 830 determines that the state in the pressure chamber 12 is normal (or that it is detected that it is not normal for less than the predetermined number of times) and that the ejecting state of the liquid droplet is normal (or is not normal Has been detected less than the predetermined number of times), it is possible to determine that it is necessary to replace the liquid droplet ejecting head 1 (see FIG. 26). On the other hand, in a case where the control unit 830 determines that the state in the pressure chamber 12 is not normal for a predetermined number of times or in a case where the control unit 830 determines that it is detected in a predetermined number of times that the ejecting state of the liquid droplet is not normal, the control unit 830 determines that it is necessary to replace the liquid droplet ejecting head 1, it is possible to notify the user to that message.

In this manner, in a case where the change in the state in the pressure chamber 12 detected before and after the maintenance is caused by the increase in bubbles in the pressure chamber 12, the control unit 830 can determine that the filters 271 to 273 are clogged. That is, the control unit 830 can determine the failure of the function of collecting the foreign matter of the filters 271 to 273 based on the change in the state in the pressure chamber 12 before and after ejecting the liquid droplet from the nozzle 21.

As illustrated in FIG. 26, after confirming that both the third filter 273 and the maintenance unit 710 are functioning properly, the control unit 830 can determine whether or not to replace the liquid droplet ejecting head 1. In this case, the control unit 830 detects the vibration waveform of the pressure chamber 12 by the detection unit 156 before and after the flushing, and the control unit can determine whether the third filter 273 is clogged based on the change in the state of the pressure chamber 12 due to the flushing. In a case where the control unit 830 determines that the third filter 273 is clogged, the control unit 830 can notify the user to that message.

In addition, the control unit 830 may detect the state in the pressure chamber 12 before the suction cleaning and during the suction cleaning.

When the negative pressure is applied to the space CK in which the nozzle 21 opens, the inside of the nozzle 21 and the inside of the pressure chamber 12 communicating with the space CK also have a negative pressure. Therefore, the vibrating plate 50 is displaced in a direction to decrease the volume of the pressure chamber 12. Therefore, when the actuator 130 is driven in a state where the vibrating plate 50 is deformed and the vibration waveform of the vibrating pressure chamber 12 is detected by the driving of the actuator 130, the vibration waveform is different from the vibration waveform detected in a state where the vibrating plate 50 is not deformed.

Therefore, the control unit 830 first detects the vibration waveform of the pressure chamber 12 in a state where the negative pressure before the suction cleaning is not applied. Subsequently, the control unit 830 detects the vibration waveform of the pressure chamber 12 in a state where negative pressure is applied during suction cleaning. The control unit 830 determines that the function of the maintenance unit 710 is normal in a case where in the pressure chamber 12 before suction cleaning and during suction cleaning has changed.

In this manner, when the space CK formed by the suction cap 770 is set to negative pressure, a negative pressure also reaches the pressure chamber 12 via the nozzle 21. In a case where the negative pressure is applied to the pressure chamber 12 and in a case where the negative pressure is not applied to the pressure chamber 12, vibration waveform of the pressure chamber 12 varies. Therefore, in the case where the state in the pressure chamber 12 is changed between before the suction cleaning and during the suction cleaning, the negative pressure is applied to the pressure chamber 12, it is possible to determine that the maintenance unit 710 is functioning normally.

Similarly, the control unit 830 may drive the suction pump 773 when the suction cap 770 is in the capping state to determine whether or not the atmosphere release valve 264 is functioning normally. In this case, in a state in which the atmosphere release valve 264 is opened and a negative pressure is not applied and in a state in which the atmosphere release valve 264 is closed and a negative pressure is applied, in the pressure chamber 12 compare the states.

In this manner, when detecting the vibration waveform of the pressure chamber 12 during the suction cleaning, a valve may be provided upstream of the pressure chamber 12, and suction cleaning may be performed with the valve closed. That is, by providing a valve, consumption of liquid can be reduced, and the vibrating plate 50 can be easily deformed.

OTHER MODIFICATION EXAMPLES

The above embodiment may be modified as in the following modified example. The configuration included in the above embodiment can be combined in a predetermined manner with the configuration included in the following modification examples. The configurations included in the following modification examples can be combined in a predetermined manner.

The nozzle inspection at the time of capping (processing flow in FIG. 20) may be performed in a capping state with the suction cap 770. In this case, the liquid can be discharged into the suction cap 770 according to the result of the nozzle inspection. In this case, the liquid droplet ejecting apparatus 700 may not include the moisturizing cap device 800.

The liquid droplet ejecting apparatus 700 may be replaced with a so-called full line liquid droplet ejecting apparatus including the long liquid droplet ejecting head 1 corresponding to the entire width of the medium ST without including the carriage 723.

In addition to the actuator 130 for ejecting ink droplets from the nozzle 21, a sensor for detecting the vibration waveform of the pressure chamber 12 may be provided as the detection unit 156. The control unit 830 may determine the state of the pressure chamber 12 based on the vibration waveform of the pressure chamber 12 detected by the sensor (detection unit 156). In this case, a piezoelectric element may be adopted as the sensor.

The liquid ejected by the liquid droplet ejecting head 1 is not limited to ink, and may be, for example, a liquid material in which particles of a functional material are dispersed or mixed in a liquid or the like. For example, the liquid droplet ejecting head 1 may eject the liquid material containing the material such as an electrode material or a coloring material (pixel material) used for manufacturing the liquid crystal display, an electroluminescence (EL) display, a surface emitting display, or the like in a dispersed or dissolved state.

The medium ST is not limited to paper, but it may be a plastic film or a thin plate material, or a cloth used for a textile printing apparatus or the like. The medium ST may be a clothing having a predetermined shape, such as a T-shirt, or a three-dimensional object having a predetermined shape such as dishes or stationery.

The entire disclosure of Japanese Patent Application No. 2017-133750, filed Jul. 7, 2017 is expressly incorporated by reference herein.

What is claimed is:

1. A liquid droplet ejecting apparatus comprising:

a liquid droplet ejecting head that includes a pressure chamber to which a liquid is supplied from a liquid supply source, a nozzle that communicates with the pressure chamber, and an actuator that vibrates the pressure chamber, and discharges a liquid droplet from the nozzle by driving of the actuator;

a cap designed to make a capping state where the cap is in contact with the liquid droplet ejecting head to form a space where the nozzle opens and a non-capping state where the cap is separated from the liquid droplet ejecting head; and a detection unit designed to detect a state in the pressure chamber, wherein in the capping state, the detection unit detects the state in the pressure chamber.

2. The liquid droplet ejecting apparatus according to claim 1, wherein in a case where the detection unit detects that the state in the pressure chamber is not normal, a maintenance of the liquid droplet ejecting head is performed by discharging the liquid from the nozzle.

3. The liquid droplet ejecting apparatus according to claim 1, wherein the detection unit detects the state in the pressure chamber by detecting a vibration waveform of the pressure chamber, and the liquid droplet ejecting apparatus further comprises a control unit that estimates a degree of progression of thickening of the liquid in the pressure chamber by comparing the vibration waveforms of the pressure chamber detected by the detection unit with a time interval in the capping state.

4. The liquid droplet ejecting apparatus according to claim 3, wherein in a case where a result of the estimation exceeds a standard set as the degree of the progression, a maintenance of the liquid droplet ejection head is performed by ejecting the liquid from the nozzle.

5. The liquid droplet ejecting apparatus according to claim 4, wherein when the standard is set as a first standard and the degree of the progression in which a thickening is progressed more than the first standard is set as a second standard, in a case where, the estimation result of the detection unit exceeds the second standard, the control unit determines that the state of the cap is abnormal.

6. The liquid droplet ejecting apparatus according to claim 3, wherein in the capping state, a maintenance of the liquid droplet ejecting head is performed by micro-vibrating the pressure chamber to such a degree that the liquid is not ejected from the nozzle by driving the actuator.

7. The liquid droplet ejecting apparatus according to claim 6, wherein by performing the micro-vibration during an interval after the detection unit performs the detection and before the detection unit performs a next detection, in a case where the thickening of the liquid in the pressure chamber progresses faster than when the micro-vibration is not performed during the interval, the next micro-vibration is performed by reducing a driving energy of the actuator.

8. The liquid droplet ejecting apparatus according to claim 6, wherein by performing the micro-vibration during an interval after the detection unit performs the detection and before the detection unit performs a next detection, in a case where the thickening of the liquid in the pressure chamber progresses faster than when the micro-vibration is not performed during the interval, the next micro-vibration is not performed.

9. A method for maintenance of a liquid droplet ejecting apparatus including a liquid droplet ejecting head that includes a pressure chamber to which a liquid is supplied from a liquid supply source, a nozzle that communicates with the pressure chamber, and an actuator that vibrates the pressure chamber, and discharges a liquid droplet from the nozzle by driving of the actuator, a cap designed to make a capping state where the cap is in contact with the liquid droplet ejecting head to form a space where the nozzle opens and a non-capping state where the cap is separated from the liquid droplet ejecting head, and a detection unit designed to detect a state in the pressure chamber, the method comprising:

in the capping state, detecting a state in the pressure chamber; and in a case where the detection unit detects that the state in the pressure chamber is not normal, performing a maintenance of the liquid droplet ejecting head by discharging the liquid from the nozzle.

* * * * *